United States Patent [19]

Leonard

[11] 4,347,993

[45] Sep. 7, 1982

[54] TENSION MONITOR MEANS AND SYSTEM

[75] Inventor: Michael R. Leonard, Manchester, Mo.

[73] Assignee: W. J. Industries, Incorporated, Fenton, Mo.

[21] Appl. No.: 91,738

[22] Filed: Nov. 6, 1979

[51] Int. Cl.[3] ..... B65H 23/04

[52] U.S. Cl. ..... 242/75.51; 242/75.44; 318/6

[58] Field of Search ..... 242/75.51, 75.52, 75.44; 226/44, 42, 43, 36; 318/6, 7

[56] References Cited

U.S. PATENT DOCUMENTS

| | | | |
|---|---|---|---|
| 3,283,228 | 11/1966 | Asseo | 242/75.51 X |
| 3,419,771 | 12/1968 | Bentley et al. | 242/75.51 X |
| 3,507,459 | 4/1970 | Campbell, Jr. | 242/75.51 X |
| 3,674,221 | 7/1972 | Riemersma | 242/75.51 |
| 3,713,009 | 1/1973 | Poppinger et al. | 318/7 X |
| 3,778,005 | 12/1973 | Gruniger et al. | 242/75.51 X |
| 3,809,335 | 5/1974 | Mantey | 242/75.51 X |

*Primary Examiner*—John M. Jillions
*Attorney, Agent, or Firm*—Charles B. Haverstock; Robert M. Garrett; Herbert B. Roberts

[57] ABSTRACT

A tension control system for use with a device which includes at least one roll over or around which a web or strand of material passes, a tension responsive transducer associated with the roll, a reference tension selector, a drive unit for effecting movement of the web or strand over or around the roll, and a tension controller associated with a tension control roll, the tension controller responsive to the outputs of the transducer and of the reference tension selector for controlling the torque applied to the tension control roll in order to control tension on the web or strand, the improvements comprising a control circuit connected between the transducer and the tension controller including an error limiter circuit responsive to the outputs of the transducer and of the reference tension selector to produce an error signal, the control circuit having circuit elements responsive to the error signal and connected to vary the torque applied to the torque control roll in a manner to maintain the web or strand tension substantially constant at the reference tension selected. The subject system optionally also includes circuits therewith for rapidly reducing or eliminating the torque applied to the drive control roll whenever the web or strand tension is greater than the reference tension selected, for limiting the maximum possible torque that can be applied, for eliminating all torque during starting and restarting and for thereafter gradually reestablishing a desired torque corresponding to the reference tension selected.

56 Claims, 5 Drawing Figures

TENSION MONITOR MEANS AND SYSTEM

The present invention relates to a tension control system for controlling the tension on a web or strand of material passing a tension roll, and especially to a closed loop, feedback system designed to measure and control tension on any moving web or strand in unwind, rewind, or point-to-point tension control applications.

There are in existence many devices for controlling tension on a strand or web of material and particularly on a moving strand or web as it is unwound from a roll or spool, moves through, over, around, and between various feed rolls and ultimately is rewound onto a take up roll or spool or is otherwise processed. There are numerous such systems where tension control devices are required if the process is to work satisfactorily and the web or strand is not to be undesirably strained. Typical of applications and systems where such control is required are continuous printing applications, plastic and other film forming and extruding operations, various processing applications, weaving applications, wire drawing applications, film and tape winding, and many other applications. Most such applications have a payout roll or spool from which material is drawn and in which the effective diameter of the roll, and the roll inertia, change as more material is drawn off. Many such applications also include take-up or rewind rolls or spools onto which the material is rewound and in which the effective roll diameter and roll inertia increase as the operation proceeds. Between the payout roll and the rewind roll may be any number of other rolls or pairs of rolls around which and between which the material moves. Some or all of these rolls may undergo changes depending on the tension forces on the web or strand as it moves thereby. In order to produce the most desirable operating condition it is usually desirable to maintain some desired tension on the web or strand. The characteristics of the material involved as well as the process will determine the most desirable tension and how much variation in tension can be tolerated. It is also extremely important in many applications that wide variations in tension and sudden sharp tension changes or shocks be avoided to prevent damage and breakage.

The tension control system of the present invention is a feedback control system including a control circuit designed for use with a magnetic particle clutch or brake and with one or more tension sensors for measuring the tension of a web or strand passing a tension roll. It will be understood that, for the sake of convenience in that which follows, reference may be made to a web and such term is intended to apply without limitation to any substance having a strand or web-like composition, including single strands as well as intermeshed or interwoven compositions. As with all tension control systems, tension is controlled by comparing the actual tension (as read by the sensors) with a reference tension which is set by the user of the system. Any difference between these two tension values is applied to the clutch/brake to adjust the tension. Feedback control systems provide the most accurate way of controlling tension since the tension is virtually independent of process nonlinearities.

It should be recognized that in designing any such feedback systems the most important performance criteria are accuracy and response time. Accuracy indicates how close the average actual tension is to the desired tension. Average actual tension is used since the actual tension will sometimes be responding to some change in the process. Response time indicates the time it takes for actual tension to reach the desired tension after such a tension transient. A trade off exists between response time and stability. Attempts to improve the response time of a feedback system beyond a certain point may result in overshoot and consequent system oscillation. If this happens the tension of the web will oscillate (sometimes violently) about some average tension independent of any outside influences and the system will be unstable. A feedback system is optimized when the response is as fast as possible without causing oscillations.

Feedback systems are usually optimized by careful analysis of the response characteristics of all components in the system. However, the system of the present invention is designed to allow optimization without the necessity of such an analysis, and, so, offers significant advantages over previously known systems. Systems, such as the present invention, that are set up for optimization without the optimization analysis noted above may be referred to as empirically stabilized systems.

The present control system is particularly well suited for use with tension responsive devices or transducers such as are disclosed in Eddens U.S. Pat. No. 4,130,014, and with magnetic particle devices such as are disclosed in Eddens U.S. Pat. Nos. 4,085,344 and 3,962,595, all three of which are assigned to Applicant's assignee.

It is therefore a principle object of the present invention to teach the construction and operation of a novel control circuit for use as part of a tension control system.

Another object is to reduce waste in processes where webs or strands of material are fed, processed, unwound and rewound.

Another object is to minimize the undesirable effects of transient tension conditions on moving webs and strands.

Another object is to provide means to maintain a more uniform tension condition on webs and strands of material.

Another important object is to maximize the rate of tension correction on a web or strand of material while maintaining system stability.

Another object is to provide a tension control system that can respond to relatively small tension transients quickly and which will remain stable when responding to relatively large tension transients.

Another object is to prevent damage to a web or strand of material at times when the web or strand is to be restarted moving under conditions where substantial braking force is being applied thereto.

Another object is to temporarily remove the braking force on a web or strand when starting the movement thereof so that braking force can gradually be applied as required to reach some desired tension condition.

Another object is to reduce the time lag associated with the inductance of a brake device when the brake device is operating at relatively low current levels thereby enhancing system stability.

Another object is to provide means to rapidly remove greater than desired energy from the field of a braking device to reduce undesirably high braking forces that might cause damage to a web or strand.

Another object is to teach the construction of a novel closed loop control circuit for controlling the tension on a web or strand of material such as a web or strand of material extending around and between spaced rolls or spools.

Another object is to provide a web start circuit for a web feed system which includes means to prevent possible damage caused by excessively high braking forces that may by present in the system when the web is to be started.

Another object is to provide means to rapidly reduce braking force in a tension responsive system by applying excessive reverse voltages to a braking device and thereafter allowing the braking force to be ramped up to some desired level.

Another object is to provide an extremely versatile, widely adjustable tension control system that can be adjusted to maintain almost any desired tension condition on a web or strand from a very weak to a very strong tension condition, which system includes means to modify the rate of adjusting tension for different tension conditions, modulates tension extremes, and produces fast response characteristics over a wide range of tension conditions to prevent undesirable and/or unacceptable tension conditions from causing damage.

Another object is to provide a tension control system that prevents undesirable system oscillation over a wide range of tension conditions.

Another object is to provide a tension monitoring and control system that can be used to monitor and control tension at one or more locations in a web feed system.

Another object is to provide an extremely accurate and stable system for controlling and monitoring tension over a wide range of tensions.

Another object is to provide a relatively trouble free electronic tension control system constructed in large part of solid state circuit elements.

Another object is to provide a relatively inexpensive yet versatile tension control system.

Another object is to provide a tension control system that can be used with systems having single tension sensor elements located at one end or side of a roll or spool and with systems that have pairs of tension sensor elements located at both opposite ends of a feed roll or spool.

Another object is to teach the construction and operation of a tension control system that can be operated and adjusted by persons having relatively little skill and training.

Another object is to provide accurate means to maintain desired tension on a moving web or strand regardless of the speed of movement thereof.

Another object is to improve the quality and uniformity of products produced from webs or strands of material.

These and other objects and advantages of the present invention will become apparent after considering the following detailed description of a preferred embodiment in conjunction with the accompanying drawings, wherein.

Figure 1:
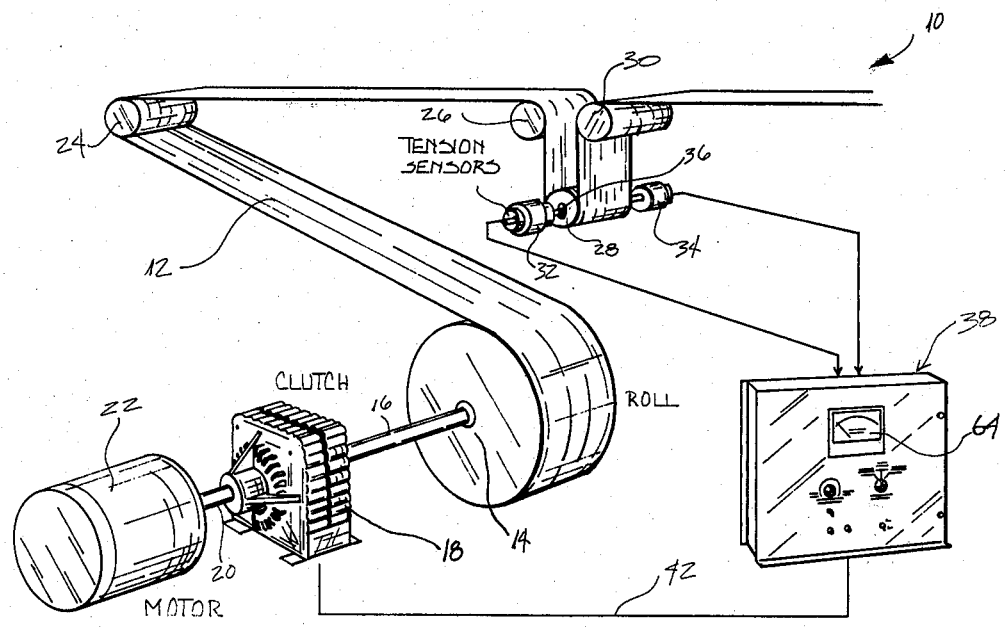
FIG. 1 is a schematic diagram of a system embodying the teachings of the present invention.

Referring to the drawings more particularly by reference numbers, number 10 in FIG. 1 refers to a simplified web feed system equipped with tension control and monitoring means constructed according to the present invention and used for controlling the tension on a web or strand such as on web 12. The web 12 is shown being wound onto a take-up roll or spool 14 mounted on shaft 16. The shaft 16 is connected to the output of a clutch device shown as magnetic particle clutch 18. The clutch 18 has an input shaft 20 which is coupled to the output shaft of a motor 22. When the motor 22 is operating the shaft 16 will rotate the spool 14 to wind the web 12 thereon.

The web 12 is shown extending around a feed roll 24 and then back around other feed rolls 26, 28 and 30. From there the web 12 could extend around any number of other similar feed rolls and/or through other means where something is done to the web, and it can also extend around and be drawn from a payout roll (not shown).

Of significance with respect to the present invention are tension sensor means 32 and 34, shown attached to opposite ends of shaft 36 on which the roll 28 is mounted. The sensors 32 and 34 may be similar to the sensors or tension monitor means disclosed and described in Eddens U.S. Pat. No. 4,130,014. It is sufficient for present purposes to note that the sensors 32 and 34 include means, which may include transducers connected into Wheatstone bridge type circuits, for producing responses when web tension is applied to the roll 28 and to the shaft 36. The tension forces thus applied produce changes in sensor means 32 and 34, and the outputs therefrom are available to be connected to the input circuitry associated with the subject device. The details of the construction and operation of the sensors or transducers 32 and 34 and of their connections into the subject circuit are only of general interest, are not at the heart of the present invention, and need not be described in any greater detail in this application. The output connections of the sensors 32 and 34 in the construction as shown in FIG. 1 are fed as inputs of the subject tension control system to a control panel or box 38 in which most of the circuitry for the subject system is located. The control panel 38 has various operator adjustable controls on it which may be adjusted to establish the desired tension condition, and these controls are shown mounted on the front wall of the control panel 38 which also has an indicator 64 to indicate web tension. The control panel 38 also has an input lead 42 which has its opposite end connected to the magnetic particle clutch or brake 18, which may be similar to the clutch or brake disclosed and described in Eddens U.S. Pat. Nos. 3,962,595 and 4,085,344. The signals present on the lead 42 are used to control the coupling force produced between the input and output of a device such as the magnetic particle clutch or brake 18 shown in the drawings, and this affects the web tension.

Thus, the user may select a desired tension condition by adjustment of operator adjustable controls on the control panel 38, and thereafter the web tension will be controlled by the subject system to substantially maintain the desired condition. Signals from the sensors 32 and 34 will be compared to the reference signal associated with the desired tension condition and any difference therebetween will result in generation of an appropriate signal on output lead 42 to cause the magnetic particle clutch or brake 18 to respond in such a way to correct any deviation from the desired tension condition and to bring the actual tension condition into substantial conformance with the selected, desired tension condition. The various circuits and circuit elements, and particularly those mounted in the control panel 38, are important to the present invention and will be more fully described hereinafter. At this point, however, it is sufficient to recognize that as web 12 is fed over and around the feed roll 28, the sensors 32 and 34 will respond to the tension produced thereon and will produce outputs which are provided to the subject control means for control and monitoring purposes. As will be explained, the values of these inputs are important to the operation of subject control means. At the same time the web is moving around the roll 28 it is being wound onto roll 14, and as the size or diameter of the roll 14 increases it will affect the web tension, including the inertia forces produced by the increasing size of the roll 14. The subject circuit is designed to take into account all of these and various other conditions that affect web tension in order to maintain the web tension at some particular desired tension condition.

Figure 2:
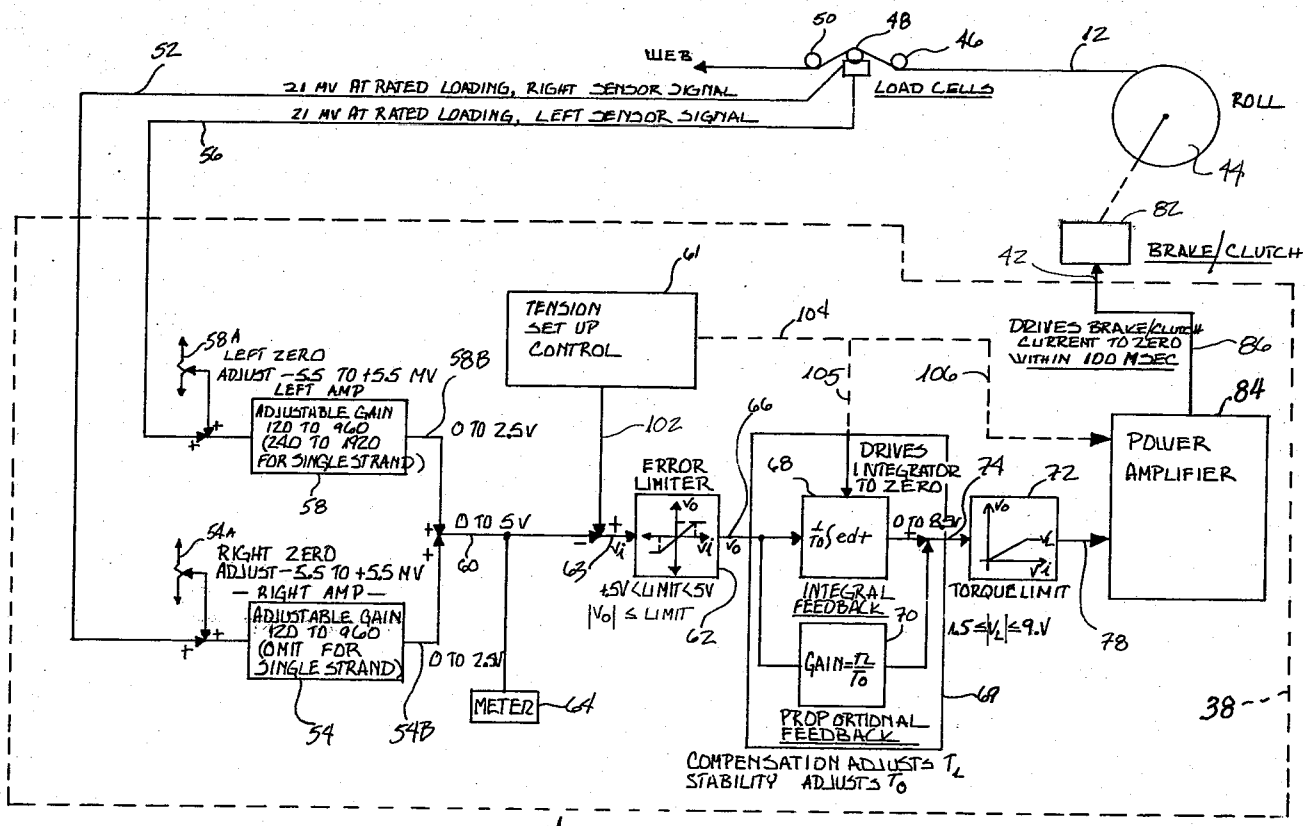
FIG. 2 is a diagram of a tension control and monitoring system constructed according to the present invention showing in block diagram the more important circuit components of the present invention.

FIG. 2 is a diagram of a tension control and monitoring system employing a magnetic particle brake and showing the principal circuit components and elements of the present invention and their interconnections, most of which are included in the control panel 38. In FIG. 2 the web 12 is shown being unwound from a feed roll or spool 44 and thereafter moving between spaced feed rolls 46, 48 and 50. The feed roll 48 (which may be equivalent to feed roll 28 in FIG. 1) is the one that has sensors, such as sensors 32 and 34, associated with its opposite ends. It is apparent, however, that if a strand of material, rather than a web, is being fed, it may be necessary to have only a single sensor, located at one end or side of the feed roll, instead of a pair of sensors with one being located at each end of the roll. Additionally, there may be other instances in which a sensor need be located at only one end of a feed roll to achieve desired results, but it will be apparent that it is usually preferable to have sensors at both ends of a roll to realize the most desirable operating conditions.

In the construction as shown in FIG. 2 the sensor 32, located at one end of the feed roll, produces output signals on connector 52, which signals are fed to a circuit identified as adjustable gain circuit 54, and the sensor 34, located at the opposite end of the feed roll 48, is connected and feeds signals via connector 56 to another adjustable gain circuit 58. The circuits 54 and 58, which may include user operable zero adjust potentiometers, such as the zero adjust potentiometers 54A and 58A that can be employed for independent zero adjustment of the respective circuits 54 and 58, are employed to amplify the low level output signals from the respective sensors 32 and 34 to levels that will be compatible with the remainder of the system and which can be read on a meter, such as on meter 64, to provide a visual indication of actual tension conditions. Maximum temperature stability may be obtained by employing the separate gain circuits together with full bridge configurations associated with the transducers in sensors 32 and 34. In systems where the transducers employed have less than complete bridge circuits associated therewith, it has been found desirable to provide additional optional circuitry, which circuitry would typically include bridge completion resistors and other circuitry well known to those skilled in the art, so as to closely approximate and realize the advantages that would be obtainable if a complete Wheatstone bridge circuit were used. Such optional circuitry, though generally somewhat less accurate and sensitive than constructions that employ a full Wheatstone bridge with each set of transducers, nevertheless yields highly satisfactory results.

It should be recognized that although it is generally desirable to employ the gain circuits 54 and 58, such circuits need not necessarily be utilized in all instances if the signals from the sensors 32 and 34 are already of sufficient magnitude or if the remainder of the tension control system is designed for receipt of and response to the signal levels being produced by the sensors 32 and 34. In most instances, however, it will be desirable to include some type of adjustable gain means in the system to permit amplification of low level signals produced by the particular sensor means employed. When gain circuits such as circuits 54 and 58 are employed, individual outputs therefrom are produced on leads 54B and 58B, respectively, and these outputs are summed on lead 60 and provided to meter 64 to make available to the user a visual indication of the combined outputs of the two sensors or transducers 32 and 34. If desired, the meter 64 may be so connected to the system to also allow the user to independently observe the tension reading obtained from either of the sensors 32 or 34, and the use of the separate gain circuits 54 and 58 for the sensors 32 and 34, instead of a single gain circuit to amplify a summed signal from the separate sensors, allows such connection to be easily accomplished.

The signal thus produced on lead 60 is thereafter compared to a reference signal on lead 102, which reference signal corresponds to a desired tension value established by the system user. The reference signal on lead 102 is established by adjustment of the operator adjustable controls on control panel 38, which controls are included in tension setup control means 61. The tension control means 61 may take many forms, and some of these forms will be discussed in more detail hereinafter with respect to other features of the subject system. At this point, however, it is sufficient to note that any means capable of generating a reference signal on lead 102 at a signal level compatible with the remainder of the system is acceptable and may be employed, and many such means are well known to those skilled in the art. A difference signal reflecting the value difference between the signals appearing on leads 60 and 102 is generated on lead 63, and this difference signal, corresponding to tension deviation from norm at a given time, is fed as an input to an error limiter circuit 62, the construction and operation of which are highly significant and important to the present invention, as will be explained.

The error limiter circuit 62 is constructed to produce an output which varies, in proportion to the inputs it receives, over a limited range of inputs, but not over the full range of possible inputs. For example, if the signal appearing on lead 63, which signal represents the amount of detected tension variation from norm at a given time, is less than a selected, predetermined value, the output of the error limiter 62 will be proportional to the signal appearing on lead 63. If the signal appearing on lead 63 equals or exceeds the predetermined value, however, the signal produced at the output of the limiter circuit 62 will be limited to some maximum possible value. What this means, in essence, is that tension deviations that are less than the preset limit level will be passed through the error limiter circuit 62 whereas tension deviations that equal or exceed the preset limit level will result in output signals limited in magnitude to the maximum limit value. This error limiting feature, in conjunction with the proportional-plus-integral feedback network which will be dicussed hereinafter, results in increased dampening for large transients without affecting the system response to small transients. Even though this means that some deviations from the most desirable tension condition may occur when relatively large transient tensions are sensed, the entire effect is to yield improved overall system response since the system itself need not be slowed to stabilize large transients. Additionally, the use of error limiter circuit 62 limits the magnitude of oscillations which occur during set-up of empirically stabilized systems, allows for a more critical adjustment of stability/compensation controls, which yields improved system response, allows the system to be optimized independently of the non-linearities which can occur with large transients, and allows use of the entire system in a wider range of applications. All these are highly desirable features. For ease of use and convenience to the user the error limiter circuit 62 will typically include adjustment means that allow the user to preselect a limit level which, in this embodiment, ranges between approximately 10% and 100% of the rated output of the circuit. For example, with the error limiter circuit of FIG. 2, the limit level may be selected to fall in the range of approximately 0.5 V of 5 V. It may also be desirable, in many applications, to so construct the error limiter, and perhaps other system components as well, to include minimum signal recognition threshholds. With such threshholds deviations within a narrow range would be tolerated without attempts by the system to correct for such deviations. Such threshholds are generally desirable and eliminate the problem of a system attempting to correct for momentary transients and then having to correct for the corrections after the momentary transients have passed.

The output 66 of the error limiter circuit 62 is fed as an input to a proportional-plus-integral feedback network 69 that includes an integrator circuit portion 68 and a proportional feedback circuit portion 70, which circuit portions may be parts of the same circuit, as will be explained hereinafter. The function of the feedback network 69 is important to the novelty and usefulness of the present invention, especially when employed in conjunction with the error limiter circuit 62, and the circuit details of the feedback network will be further explained in connection with FIG. 5. At this point it is sufficient to note that were the tension detected by the sensors 32 and 34 to suddenly deviate from norm, the integral feedback portion of the feedback network 69 would cause the output of the system to change at a rate proportional to the error between the tension displayed on panel meter 64 and the tension commanded via the operator adjustable tension selection means on the control panel 38 until such time as the error would eventually be driven to zero. The basic response time of the system to a detected error condition is determined by the design of the integral feedback portion of the feedback network and may be altered by way of operator adjustable means that change the integrator time constant. The proportional feedback portion of feedback network 69 supplements the integral feedback and results in production of a signal which improves the response of the system. Operator adjustable means also allow the user to adjust the proportional feedback to obtain optimal system response characteristics. Since the amount of error that can be applied to the proportional-plus-integral feedback network 69 is limited by the error limiter circuit 62, the system response to large transients is slowed without affecting the response to small transients, but the entire system need not be slowed to stabilize large transients. It will thus be appreciated that the use of the error limiter circuit 62 in conjunction with proportional-plus-integral feedback provides triple mode compensation and results in a significantly improved and more versatile control system that may be easily and quickly empirically stabilized. For example, because of its triple mode compensation capability the subject system may be used for many different applications, ranging from use with very stretchy materials to use with stiff brittle substances, without any resort to a decrease in open loop gain. This is important and quite desirable since decreased open loop gain would result in a significant deterioration of the system accuracy. Operator adjustable means, such as modified log taper potentiometers typically able to obtain an adjustment range of about 165 to 1 in a single turn of the potentiometer, are preferably provided in the feedback network 69 to enable the user to adjust the proportional-plus-integral feedback to achieve optimal system response.

As depicted in FIG. 2, feedback network 69 may, for convenience of description, be viewed as including an integrator circuit portion 68 and a proportional feedback circuit portion 70, which circuit portions operate in conjunction with one another and with the error limiter circuit 62 to control the accuracy and stability of the system and to produce output responses for correcting any tension deviation from norm that is detected. When the network 69 is so viewed, each of the portions may be considered to produce outputs, which outputs are summed and result in production of a proportional-plus-integral feedback signal on output led 75 from feedback network 69. As has previously been indicated, though, the integrator circuit and proportional feedback circuit portions may, in practice, be part of the same circuit. Consequently, while the combined proportional-plus-integral feedback signal produced may be readily indentifiable in a particular circuit configuration, one may not always be able to identify distinguishable and independent integrator circuit portion and proportional feedback circuit portion outputs in that circuit. However, this is of no great consequence since what is important is that a combined proportional-plus-integral feedback signal is produced on lead 74 as an output from feedback network 69, which signal will be employed to control the particular clutch or brake 82 employed with the feedback control system to correct the tension deviation from norm of the material web or strand.

As is further shown in FIG. 2, the output signal on lead 74 from the feedback network 69 is provided as an input to a torque limit control circuit 72, the purpose of which is to provide a means for limiting the maximum current that can be applied to the particular magnetic particle brake or clutch that is employed with the feedback control system to correct the tension deviation from norm. While the torque limit control circuit is not necessarily required in the present system, it has been found desirable to include such a component in the system since the various brakes and clutches that may be employed with the system have different specifications and characteristics and since some of such brakes and clutches could be damaged if the current applied thereto were excessive for their design and construction. The torque limit control circuit 72, by limiting the magnitude of the signal produced at its output 78, thus acts to prevent application of excess current to particular brakes and clutches thereby minimizing risk of damage to such brakes and clutches. Typically, the torque limit control circuit may be adjustable between approximately 20% and 100% of the selected current range. By using the torque limit control circuit 72 to clamp the output signal produced on lead 78 to some maximum value it is possible to protect the various brakes and clutches employed while still preserving the high accuracy of the integrator circuit portion 68 since increased feedback around the integrator circuit portion 68 is not required.

The output 78 from the torque limit control circuit 72 is provided as an input to a power amplifier circuit 84 which includes a linear feedback current amplifier circuit portion of high open loop gain for producing on output lead 86 of the power amplifier circuit a signal proportional to the input voltage on lead 78 for controlling the action of the brake or clutch 82. The power amplifier circuit 84 will be more fully described hereinafter with reference to FIG. 5, but for present purposes it is sufficient to note that amplifier circuit 84 is so designed and constructed that if the actual detected tension is less than that desired by even a small amount, resulting in a negative deviation from norm and a resulting signal on lead 78, the amplifier will saturate and maximum rate of change of brake current will therefore result, thereby effecting correction of the tension deviation from norm. On the other hand, if the actual detected tension is greater than that desired by even a small amount, resulting in a positive deviation from norm and a resulting signal on lead 78, the amplifier will cut off, and, as the energy stored in the brake's magnetic field is then removed or dissipated, the brake current will be reduced thus effecting tension deviation correction. The time required to accomplish such energy dissipation would normally be dependent upon the brake time constant. In the subject system, however, energy dissipation circuitry is included in the power amplifier circuit 84 to achieve faster dissipation, and this faster dissipation is accomplished by dumping the energy into a high voltage, high power Zener diode circuit which will be presented more in detail with reference to FIG. 5, with the result that fast brake turnoff can be effected, the importance of which will be explained more fully hereinafter. It should nevertheless be recognized at this point that with such energy dissipation circuitry the time needed to remove a high, potentially damaging torque from the roll and the material passing over it is significantly reduced, and this is especially important when the system is subjected to a high torque condition at a time when relatively less torque is required to achieve the desired tension condition. The effect of reducing high torque in the above manner is the same as would be obtained by application of a reverse voltage equal to the voltage of the Zener diode to the braking means. Such a method of torque, and hence tension, correction had advantages in the present device in that the circuitry required to accomplish it is much simpler and therefore less expensive than a comparable power amplifier circuit required to drive both positive and negative going voltages. Also, such circuitry lends itself to the inclusion of a reverse current drag reduction circuit which has certain distinct advantages, and these advantages and the features of such circuitry will become more apparent from that which follows hereinafter.

Consequently, it will be appreciated that a tension deviation from norm as detected by the system will result in a continual change in signal to the clutch or brake 82, and, hence, a correction in the amount of tension of the material, until such time as the tension has returned to the desired condition. The proportional-plus-integral feedback, with the error limiter circuit, permits the system to be easily and quickly set up by the user to be able to provide a rapid correction for small deviations from norm and a slower correction for large deviations from norm while maintaining optimal system response settings in the proportional-plus-feedback network and while preserving system stability. Whereas prior art constructions would have required a sacrifice in system stability with respect to response to large deviations in order to achieve optimal response for small deviations, or a sacrifice in optimal response with respect to small deviations in order to achieve improved system stability for large deviations, the present system can achieve both optimal response for small deviations and stability for large deviations because of the novel use of an error limiter circuit in conjunction with proportional-plus-integral feedback, and the system is thus more versatile and convenient to use than any known feedback control system.

Figure 4:
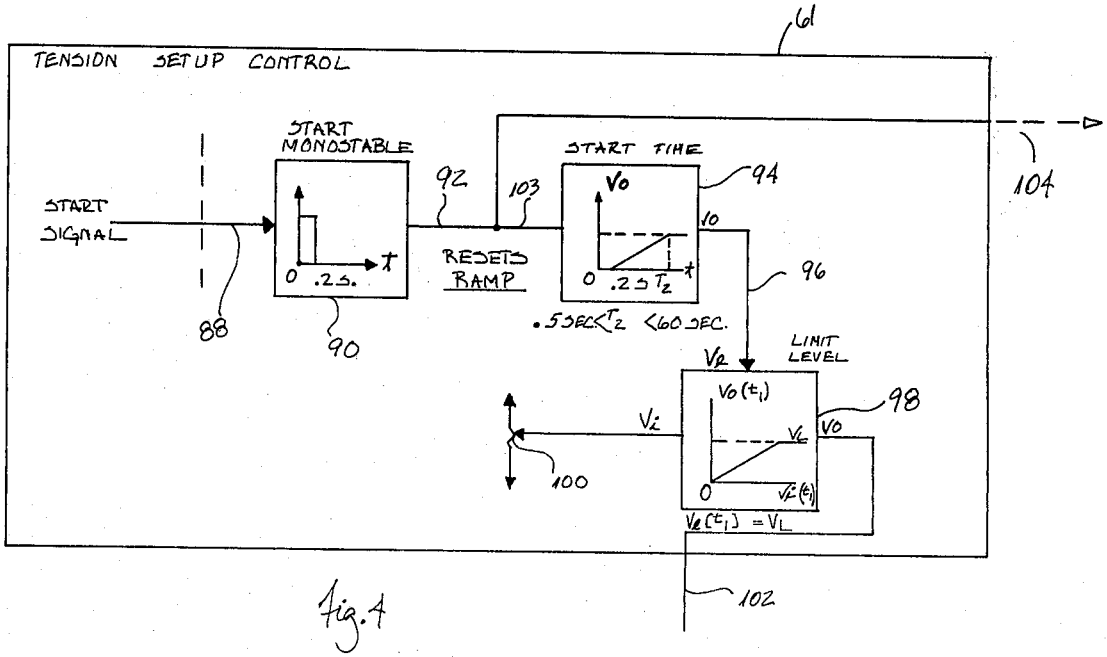
FIG. 4 shows in block diagram form further features that may be included in the Tension Set-up portion of FIG. 2.
Figure 5:
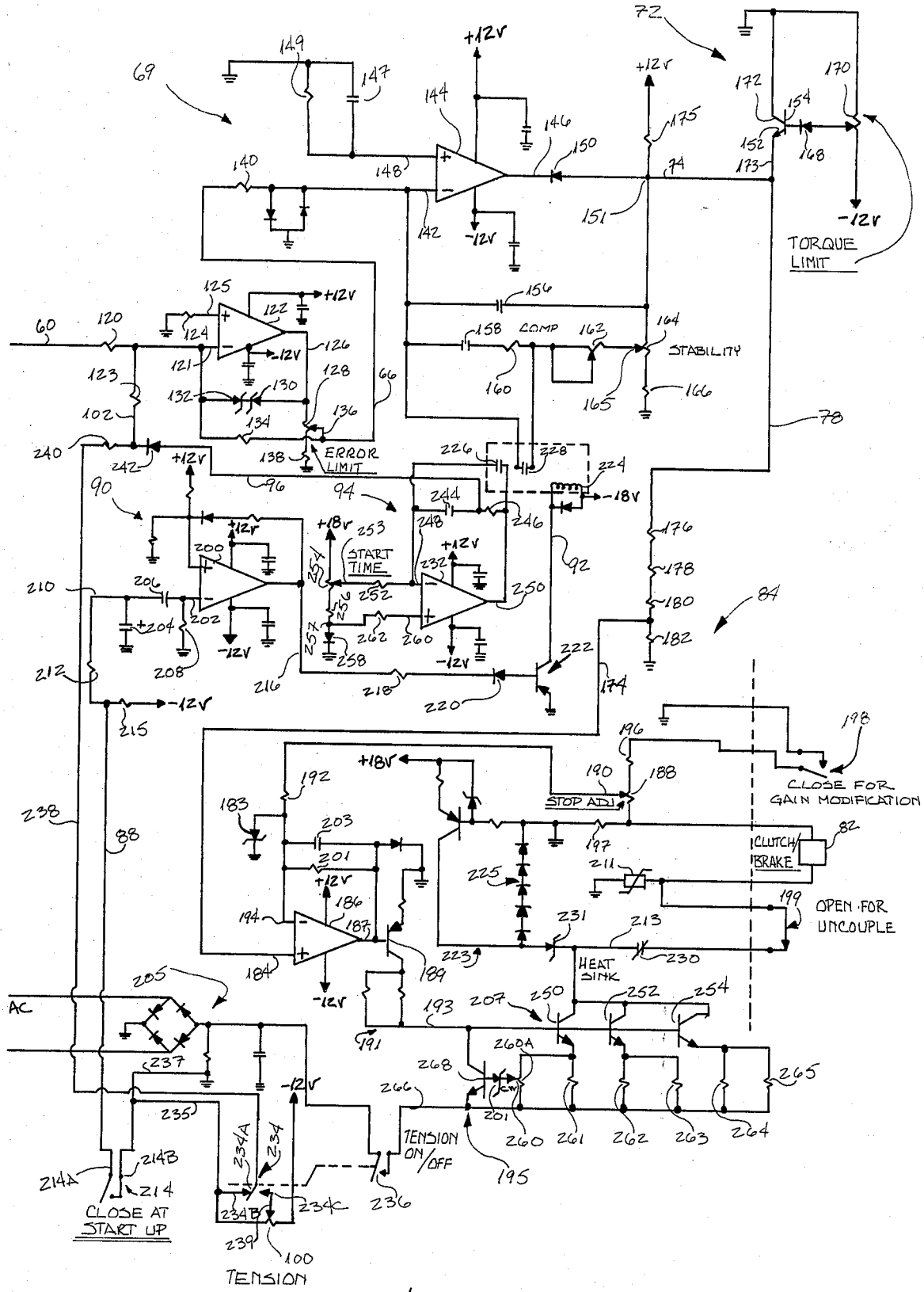
FIG. 5 is a detailed circuit diagram of the circuit of FIG. 2, including the additional features depicted in FIGS. 3 and 4.

While the subject feedback control system has thus been generally described and its operation explained, it will be appreciated that a variety of additional features that will make the system even more versatile and convenient may also be employed, and signal coupling means 104–106, which are depicted as leads in FIG. 2 and shown in dotted outline coupling the tension setup control means 61 to integrator circuit portion 68 and to power amplifier circuit 84, pertain to such additional features which will be described hereinafter, particularly with respect to FIGS. 4 and 5.

Figure 3:
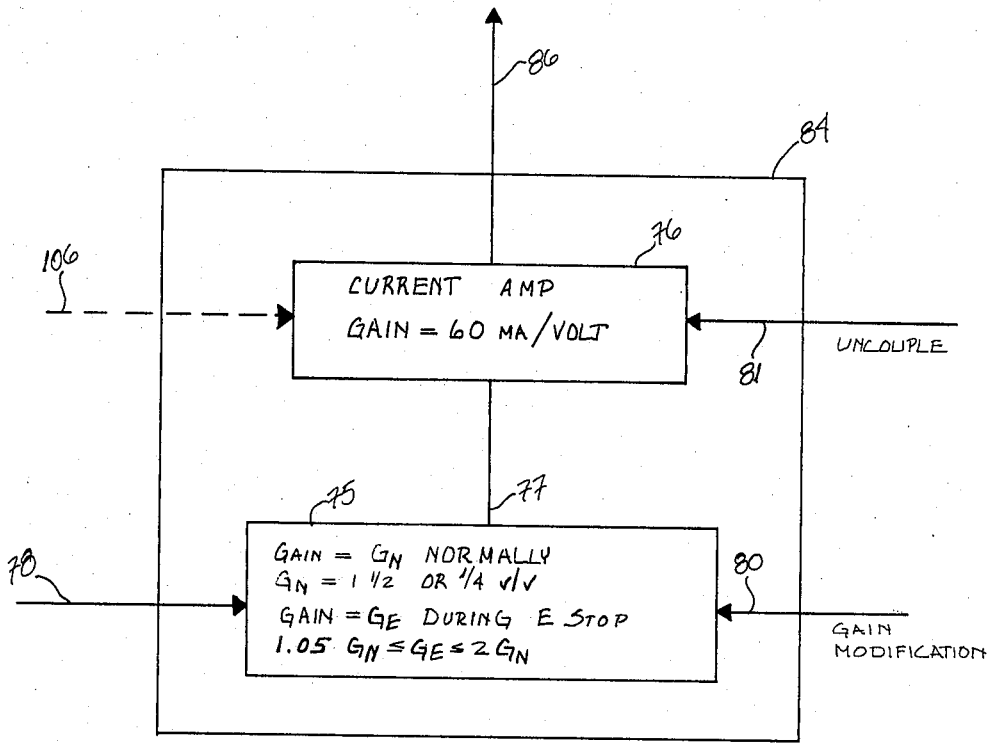
FIG. 3 shows in block diagram form further features that may be included in the Power Amplifier portion of FIG. 2.

FIG. 3 depicts in more detail a power amplifier circuit 84 of the type that may be employed in the subject tension control system, which power amplifier circuit includes a gain control portion 75 and a current amplifier portion 76. Though functionally depicted in FIG. 3 as separate circuit portions within the power amplifier circuit 84, gain control portion 75 and current amplifier portion 76 may both be part of the same circuit, as will be shown and described in more detail in connection with FIG. 5. For present purposes, however, gain control portion 75 may be viewed as a functionally separate circuit having an input lead 78 connected to receive the output signal produced by the torque limit circuit 72 (FIG. 2) and an output lead 77 connected as an input to current amplifier portion 76. Gain range selection means (not shown) may be provided with gain control portion 75 to permit gain adjustment so that low speed response need not be sacrificed when using a brake having inherently higher gain, and, in the preferred embodiment of FIG. 3, such selection means can be utilized to select a gain $G_N$ of 1, $\frac{1}{2}$, or $\frac{1}{4}$ v/v for gain control portion 75.

In its preferred form gain control portion 75 also includes an input means 80 that can be provided, as will be described later, to receive gain modification signals during the course of operation of the subject tension control system, and further means responsive to receipt of such gain modification signals to effect an increase in the gain of gain control portion 75, the purpose of which will be explained more fully below. For present purposes, however, it is sufficient to note that receipt of a gain modification signal will result in an increase in gain, and that gain control portion 75 may include adjustable control means therewith to allow the system operator to establish the gain increase to be realized upon receipt of a gain modification signal. As is depicted in FIG. 3, in the preferred embodiment such adjustable control means allow the system operator to adjust the gain increase so that the resulting gain $G_E$ of gain control portion 75 falls within a range of 1.05 $G_N$ to 2 $G_N$.

Current amplifier portion 76 of power amplifier circuit 84 is connected to output lead 77 of gain control portion 75 and includes a linear current amplifier of high open loop gain responsive to the voltage output from gain control portion 75 for controlling via output lead 86 the brake or clutch employed with the subject tension control system. As has previously been described, if the current being delivered to the clutch or brake is such that a negative tension deviation from norm is detected, the amplifier will saturate thereby effecting an increase in brake current. On the other hand, if the actual current being supplied results in a positive tension deviation from norm, the amplifier will be cut off thereby forcing the current to flow through a high power Zener diode and effecting a rapid reduction in current. It is this latter feature of the amplifier which permits fast brake turnoff, the importance of which will be discussed more fully hereinafter.

In its preferred form current amplifier portion 76 also includes an input means 81 that can be provided, as will be explained further in what follows, to receive uncouple signals during the course of operation of the subject tension control system, and it may include further means responsive to receipt of such uncouple signals to effect a rapid reduction in clutch current and the uncoupling of the input shaft of the clutch from the output shaft thereof, the purpose of which will be explained more fully hereinafter. For present purposes, however, it is sufficient to note that receipt of an uncouple signal will cause a large reverse voltage to be applied to the clutch coil, which reverse voltage is greater than that produced during normal operation of the subject tension control system and is large enough to drive the current through even the largest known brake or clutch to zero within about 200 msec or less. This is accomplished, as will be explained more fully with respect to FIG. 5, by dumping the coil energy of the clutch or brake into a voltage suppressor, which operation is similar to that described hereinbefore with respect to the fast brake turn-off feature of current amplifier portion 76.

Current amplifier portion 76 may also be viewed as including, in its preferred embodiment, an input means 106 that can be provided, as will be explained more fully hereinafter, to receive drive system start-up signals, and it may include means therewith responsive to receipt of such drive system start-up signals to effect elimination of current through the brake or clutch, and, so, elimination of torque, for a brief period when the drive system is first started or restarted. The importance of this feature will be appreciated more fully after consideration of FIG. 4 and its description, and the means by which such current elimination can be effected will be depicted and described in more detail with respect to FIG. 5.

Referring again to the input means 80 and 81 which may be provided to receive, respectively, gain modification signals and uncouple signals, it will be appreciated that during the course of operation of a web feed system there at times occur instances when, for safety and other reasons, it is desirable to be able to quickly stop the web drive. Consequently, web drive control systems often have associated therewith emergency stop controls which may be activated to effect rapid termination of web drive and the cessation of web movement. In one typical application of a web feed system, a web drive control having an emergency stop control may be employed to drive a web take-up roll and to effect the feeding of a web or strand of material from an unwind or feed roll. With such a setup, actuation of the drive system emergency stop control would terminate web drive, but the result of such rapid termination might well be a significant waste of or damage to the material involved. This is because the inertia of the unwind roll, which would be the roll from which the web or strand of material would be drawn, would be sufficient to cause the roll to continue to rotate and to feed material therefrom despite termination of web drive, perhaps feeding such material onto the floor or into a contaminated area where it would be soiled or otherwise damaged and so would become waste material. If, as is depicted in FIG. 2, a controllable brake were to be associated with the unwind roll in such a web feed system, the tension control system described in reference to FIG. 2 could be advantageously employed in its normal operational mode to control the web tension of the material during the course of web drive operation, and, in the event of a drive system emergency stop, and depending upon the lag time of the subject tension control system and the inertia of the unwind roll at the time of drive system emergency stop, to bring the roll to a more rapid stop than would be the case if the subject tension control system were not employed. In this regard, it will be recognized by those skilled in the art that, for a given tension condition of the web, the output of the integrator circuit portion 68 of the subject tension control system will be proportional to the material roll size, and that a degree of inertia compensation can therefore be realized by effecting an increase in stopping torque applied to the roll. Consequently, if the emergency stop control associated with the drive control were to be connected such that actuation thereof would also result in the production of a gain modification signal at input means 80 of power amplifier circuit 84, the gain of gain control portion 75 would be increased, as has been previously explained, and the effect of this would be to momentarily increase current to the brake, and, hence, to momentarily increase braking to slow the unwind roll to a stop. It will thus be appreciated that with the described web feed system the gain modification feature of the gain control portion 75 of power amplifier circuit 84 permits more rapid termination of material feed from the unwind roll in the event of a drive system emergency stop, thereby minimizing material waste that might otherwise occur.

While it will thus be appreciated that, under certain applications, gain modification in the event of drive system emergency stop is highly desirable, it should also be recognized that there exist other applications of web feed systems and the subject tension control system in which it is desirable to reduce or eliminate current to the brake or clutch instead of increasing such current. For example, the subject tension control system could be utilized with a web feed system that employs a drive control to feed a web or strand of material towards a web take-up roll that has a take-up motor associated therewith. If, as is depicted in FIG. 1, a clutch were employed in such a system to control the amount or degree of coupling between the take-up motor and the shaft of the take-up roll, the subject tension control system could be employed to control the web tension of the material during the course of web feed system operation. In such an application, actuation of a drive system emergency stop control would result in cessation of drive of the material, but the inertia of the take-up roll at the time of drive system emergency stop would be sufficient to cause the take-up roll to tend to continue to rotate, and this tendency would be further exacerbated by the torque being applied to the roll by the take-up motor. Continued rotation of the take-up roll could then result in the application of excessive tension upon the web thereby causing damage to or breaking of the web. In its normal operation the subject control system would act, upon detection of a positive tension deviation from norm, to attempt to return the web tension to the desired value by reducing the clutch current, and, so, the coupling between the take-up motor shaft and the take-up roll, thereby reducing the effect of the take-up motor torque. However, because of the lag time of the subject tension control system, the take-up motor torque would undesirably affect the take-up roll for at least some short period of time. This time could be reduced, though, by utilizing the uncouple feature of the power amplifier circuit 84 described in relation to FIG. 3 to effect a rapid reduction in clutch current and consequent uncoupling of the input shaft of the clutch from the output shaft. Such rapid uncoupling could be accomplished by connecting the emergency stop control associated with the drive control in the web feed system described in such a manner that actuation thereof would also result in the production of an uncouple signal at input means 81 of power amplifier circuit 84. As previously described, the receipt of an uncouple signal by current amplifier portion 76 would effect the rapid uncoupling of the input shaft of the clutch from the output shaft thereof, thus minimizing the effect of take-up motor torque upon the take-up roll in the event of a drive system emergency stop.

FIG. 4 depicts in block diagram form an embodiment of tension setup control means 61 that may be employed with the subject system, which means includes therewith a novel system start-up circuit. All known feedback tension control systems suffer from a common problem that occurs when a web feed process stops or is turned off. This can occur at almost any time and for a variety of reasons, including the intentional shutting off of the web feed system. When the web feed system is stopped a tension deviation from norm will invariably occur since the web will generally go slightly slack. The tension control system will detect the deviation and attempt to correct therefor, but it will be unable to correct the error before the web feed process stops. After the web feed process has stopped, the feedback tension control system will continue to attempt to correct the tension deviation by commanding higher torque on the brake 82 (FIG. 3). At this stage the tension cannot change, though, since the web feed process is stopped and the web has ceased movement. Consequently, as the feedback control system continues to attempt correction, the brake 82 will eventually be commanded to a full on state. Thereafter, if and when the web feed system is restarted, a very high tension transient will result on the web when it begins to move since the brake would be full on, and that high tension may, in some cases, depending upon the material involved, be sufficient to damage or break the web. This is obviously highly undesirable, and can make restarting a difficult problem. To overcome such a problem with restart operations, it is necessary to reduce or eliminate the braking force as the web feed system is being restarted. One manner of accomplishing this is with the circuit embodiment of FIG. 4, which circuit effects a very desirable start up condition, by, first, removing the braking force altogether for a short period of time, and, thereafter, as the web speed increases, ramping the braking force up at some known rate until the desired tension condition is reached. The subject circuit includes means for accomplishing this, which means, upon receipt of a start signal generated by the web feed system operator, such as by depression of a start up contact switch, causes current to the brake 82 to be rapidly driven to zero and fast turn off of the brake to be effected. As previously explained with reference to the power amplifier circuit 84 (FIG. 2), energy dissipation circuitry included therein effects and enhances energy dissipation, and, hence, rapid turn off of the brake 82, by the application of a high reverse voltage to the brake. Preferably, the high reverse voltage that is produced upon a web feed system start is even greater than that produced during normal system operation so that even the largest brake will be driven to zero within a short period, such as 200 msec. The application of such a higher reverse voltage may be accomplished and effected by disconnection of the brake 82 from the semiconductor devices that control it in the power amplifier circuit 84, as will be shown more fully hereinafter with respect to FIG. 5. At the same time as fast turn off of the brake 82 is being accomplished, the start-up control circuitry of the subject embodiment will also cause the output of the integrator circuit portion 68 (FIG. 2) of feedback network 69 to be driven to zero. Because of the time delay associated with operation of the integrator circuit portion 68, if the output therefrom were not driven to zero upon a web feed system start, the integrator circuit portion 68 and the remainder of the feedback control system would still be trying to correct the tension and a relatively large tension transient might thus result after the appropriate time delay and before the web feed system has come up to speed at a time when the web could still be easily broken or damaged. By driving the integrator circuit portion 68 output to zero during the first 200 msec. of web feed system start-up, the delay time problem may be essentially eliminated. In addition, the start-up circuitry of the subject embodiment will also drive the tension reference signal on lead 102 (FIG. 2) to zero for 200 msec. during the start-up period and will therefore permit the tension reference signal on lead 102 to ramp up over a time period established by the user to the tension level established by the system operator by adjustment of the tension control means 100. Consequently, it will be appreciated that the start-up circuitry of the tension control means 61 of FIG. 4, in effect, will deactivate the feedback control system for the first 200 msec. following a web feed system start-up, and, thereafter, by means of the ramping up of the tension reference signal, gradually effect full feedback control of the brake or clutch.

More specifically, the embodiment depicted in FIG. 4 includes a lead 88 for communicating a web feed system start signal from a start control means (not shown) to a start monostable circuit 90 which is responsive to receipt of the start signal to produce an output pulse of 200 msec. duration, which output pulse is communicated via lead 92 and signal coupling means 103 to the input of a start time circuit 94. As shown in FIG. 2, lead 92 is also coupled to feedback network 69 and to power amplifier circuit 84 through signal coupling means 104–106. Consequently, the output pulse from the start monostable circuit 90 is coupled to feedback network 69, and, more particularly, to the integrator circuit portion 68 thereof, to drive the integrator output to zero for the duration of the 200 msec. pulse, and is also coupled to the power amplifier 84, and, more particularly, to the current amplifier portion 76 (FIG. 3) thereof, to effect brake turn off during web feed system start-up, as has been previously generally described. A more detailed description of how this is accomplished will be presented hereinafter with respect to FIG. 5. As has been previously indicated, the output pulse from start monostable circuit 90 is also provided as an input to start time circuit 94, which circuit is responsive to receipt of such pulse to drive the start time circuit output to zero for the duration of the such pulse; to then produce an output signal that ramps up until the start time circuit output has reached full rated value; and to thereafter maintain the start time circuit output constant at its full rated value. In a typical circuit the time required for the start time circuit output to reach its full rated value is established by the system operator. For example, with the subject embodiment, start time adjustment means may be provided to adjust the ramp time of the start time circuit 94 between a minimum of approximately 0.5 sec. and a maximum of approximately 60 sec. Such adjustment means allows the system operator to easily and quickly adjust the ramp time in accordance with the particular application and material with which the feedback control system is being employed, and this increases the versatility and flexibility of the start control circuitry and the feedback control system as a whole.

The output of start time circuit 94 is provided via lead 96 to an input of limit level circuit 98, which circuit includes another input connected to receive a signal from tension control means such as the tension control potentiometer 100. Limit level circuit 98 is responsive to receipt of the input signals from the tension potentiometer 100 and from the start time circuit 94 to produce a tension reference signal on lead 102 for use in determining the actual tension deviation from reference. For a selected tension as established by adjustment of the tension potentiometer 100, the output of the limit level circuit at any particular instant is dependent upon the output signal from the start time circuit 94. If the signal from the tension potentiometer 100 is less than the start time output signal on lead 96, the reference signal output of the limit level circuit 98 will be a function, typically a linear function, of the signal from the tension potentiometer. If the signal from the tension potentiometer is equal to or greater than the start time output signal, the reference signal output will be a constant related to the value of the start time output signal. Since, during a web feed system start-up, the start time output signal varies with time, the reference signal output of the limit level circuit 98 will also be a function of time, and, consequently, for a selected tension setting of the potentiometer, the limit level reference signal output will track the start time output signal until the start time output signal equals the signal from the tension potentiometer, following which the limit level reference signal output will remain constant at the reference level established by the adjustment of the tension potentiometer. Thus, for the first 200 msec. following start-up of the web feed system, the reference signal on lead 102 will be held at zero tension level, following which period the reference signal will begin to ramp up, at a rate as established by adjustment of start time adjustment means, until the reference signal corresponds to the tension level selected by the system user by adjustment of tension potentiometer 100, subsequent to which the reference signal will remain constant unless the tension potentiometer is adjusted or the web feed system is stopped and restarted.

Consequently, it will be appreciated that employment of the start-up circuitry in the tension setup control means 61, as depicted in FIG. 4, results, in effect, in the momentary disregard of tension errors, followed by subsequent gradual corrections in web tension, whenever the web feed system is started. This operation permits the system operator to obtain improved web feed system control while still avoiding problems that would be associated with the system were the feedback control system to continue to function as usual during web feed system start-up. A more detailed description of a start-up circuitry embodiment that may be employed to accomplish the desired results will be presented hereinafter with respect to FIG. 5, although it will be recognized by those skilled in the art that numerous start-up circuit embodiments other than that depicted in FIG. 5 may be equally as well employed.

FIG. 5 depicts a tension control system circuit embodiment constructed according to the present invention, which embodiment more particularly shows the construction of certain of the circuit portions that are depicted in block form in FIGS. 2–4. To the extent possible the numbers used to identify elements and circuit portions in FIGS. 2–4 are used to identify corresponding or similar elements or circuit portions in FIG. 5. Those circuit portions including the input amplifiers 54 and 58, and the circuits most closely associated therewith, including the transducer bridge circuits, have been omitted from the circuit of FIG. 5 since they may be of conventional design and do not in and of themselves constitute or contribute to the novelty and uniqueness of the present circuit. Additionally, all of the various biasing circuits and components are not necessarily included in FIG. 5 and some may have been omitted for purposes of clarity, but it will be understood by those skilled in the art that appropriate biasing is required and may be conventionally provided.

In the circuit shown in FIG. 5, the lead 60 is the lead on which the combination output from the input amplifiers 54 and 58 appears, while the tension reference signal, which will be discussed in more detail hereinafter, is present on lead 102. Both the combination output on lead 60 and the reference signal on lead 102 are applied through the respective resistors 120 and 123 to the negative input terminal 121 of a summing or offsetting operational (Op) amplifier 122, resulting in the production of an amplifier output at output connection 126, which output connection is connected to ground through error limiting potentiometer 128 and a resistor 138 and is also connected back to negative input connection 121 through error limiting potentiometer 128, the movable contact 136 associated therewith, and a resistor 134. A pair of Zener diodes 130 and 132 are connected to one another in back-to-back relationship between the amplifier output connection 126 and the amplifier negative input connection 121 and are employed to limit output voltage. The positive input terminal 125 of the Op amp 122 is grounded through resistor 124. The operation of the Op amplifier 122 and its associated circuitry will be readily apparent to and understood by those skilled in the art. Briefly, however, one of the characteristics of an Op amplifier, such as the Op amplifier 122, is that when a signal is present at an amplifier input, such as on leads 60 or 102, the potential on the amplifier output, such as output connection 126, must adjust itself so that the potential on the input terminal, such as negative input terminal 121, remains at virtual ground. In other words, regardless of the potential on leads 60 and 102, the potential on lead 126 must adjust so that the potential on lead 121 remains at virtual ground. This is accomplished by means of the closed loop circuitry associated with the Op amplifier, which, in the present circuit, includes the back-to-back Zener diodes 130 and 132 in parallel circuit with potentiometer 128, movable contact 136, and resistor 134. The setting of the potentiometer 128 establishes the operating characteristics of the error limiting circuitry, as previously described with respect to FIG. 2, and the signal that results at movable contact 136 in response to the signals received on leads 60 and 102 corresponds to the output of the error limiter circuit 62 (FIG. 2) and is communicated via lead 66 to the proportional-plus-integral feedback network 69 which will be described hereinafter. The voltage on lead 126 will always be within the limits established by the Zener diodes 130 and 132. Since the voltage at 136 will thus always be some fraction of the voltage on lead 126 it will be appreciated that the limit level is controlled by adjustment of potentiometer 128. The signal on movable contact 136 thereof is provided as an output signal to lead 66 and is also fed back through resistor 134 to negative input terminal 121 of Op amp 122 with the result that adjustment of potentiometer 128 changes the limit level, but not the gain of the circuit, as will be apparent to those skilled in the art.

As was discussed with respect to FIG. 2, the feedback network 69 includes circuitry for obtaining proportional-plus-integral feedback in the subject feedback tension control system, which circuitry may be depicted as including an integrator circuit portion 68 and a proportional feedback portion 70. As has been indicated, although such depiction is useful for purposes of explaining the operation and function of feedback network 69, the circuit portions 68 and 70 may be parts of the same circuit and may be so interconnected with one another that they cannot logically be separated from one another in any clearly defined manner, as might be suggested by the block diagram depiction in FIG. 2. A typical feedback network may include an input resistor 140 (FIG. 5) operatively connected at one end to lead 66 and at its opposite end to the negative input terminal 142 of another Op amplifier 144 whose positive input terminal 148 is grounded through a resistor 149 in parallel with a capacitor 147. The output terminal 146 of the Op amplifier 144 is connected through a diode 150 to a node 151 disposed between a resistor 175 connected to a positive voltage source, in this instance of +12 V, and a series circuit including potentiometer 164 and a grounded resistor 166. The node 151 is connected back to the negative input terminal 142 through a parallel circuit combination that includes a capacitor 156 in parallel circuit with a series circuit including potentiometer 164, its movable contact 165, a potentiometer 162, and a parallel circuit combination that includes a series circuit including a resistor 160 and a capacitor 158 in parallel with a normally open set of relay contacts 228. The signal resulting at node 151 corresponds to the proportional-plus-integral feedback signal discussed with reference to FIG. 2, and is provided on a lead 74 connected to node 151. The operation of Op amplifier 144 and its associated circuitry will be readily understood by those skilled in the art, and it will be appreciated that the potentiometer 162, which is labeled COMP, standing for Compensation, and the potentiometer 164 which is labeled STABILITY, are adjustable by the system operator and may be employed as described with respect to FIG. 2 to obtain optimal feed back control system stability and response.

The time constant associated with Op amp 144 depends primarily upon the values of the input resistor 140, the capacitor 158, and the potentiometer 164, and to a lesser extent, upon the values of the resistors 160 and 166, the potentiometer 162, and the capacitor 156. This is because the resistance of the input resistor 140 is selected to be relatively large when compared to the resistances of the other resistors and potentiometers in the circuit, and because the capacitance of the capacitor 158 is selected to be very much larger than the capacitance of the capacitor 156. As has already been described, the Op amp 144 and its associated circuitry operate to produce an output which results in a signal on lead 74 that corresponds generally with the output signal from feedback network 69 in FIG. 2. It will be recognized from analysis of the Op amp 144 and its associated circuitry that the amplifier output is dependent upon both the circuit time constant, which affects the integrating function, and upon the resistance value of the feedback loop, which affects the proportioning function, and it will thus be appreciated that the Op amp 144 and its associated circuitry correspond to the feedback network 69 of FIG. 2.

With the foregoing in mind it may be seen that a torque limit circuit such as the torque limit circuit 72 that was described with respect to FIG. 2 may be connected to lead 74, and might typically include an NPN transistor 154, which transistor has a base connected through a diode 168 to the movable contact of a torque limit potentiometer 170, one side of which is connected to a negative voltage bias, in this case, of −12 V, and the other side of which is connected to the collector element 172 of transistor 154 and to ground. The emitter element 152 of transistor 154 may be connected by means of lead 173 to lead 74 to receive the proportional-plus-integral feedback output signal, and if such signal goes sufficiently negative to turn transistor 154 ON, transistor 154 will clamp the signal on lead 173 to the signal level determined by adjustment of torque limit potentiometer 170. Consequently, the signal on lead 173, which lead is further connected to lead 78, is limited in accordance with the setting of potentiometer 170, and the resulting signal on lead 78, which lead is connected in FIG. 5 to power amplifier circuitry that will be described further hereinafter, corresponds to the torque limit output signal previously discussed with respect to FIG. 2.

The power amplifier circuitry shown connected between lead 78 and the clutch or brake 82 corresponds to the power amplifier circuit 84 of FIG. 2, and, while various power amplifier circuits may be employed to effect the tension control system of FIG. 2, the power amplifier circuit of the subject system, a preferred embodiment of which is depicted in FIG. 5, results in improved performance over other power amplifier circuits and faster energy dissipation than could be accomplished with more conventional power amplifiers. Consequently, it will be appreciated that the subject power amplifier circuitry further enhances and extends the capabilities and performance of the subject tension control system and that its design and operation are important in their own regards. Nevertheless, while the subject power amplifier circuit is thus important to the present feedback control system, all the details of its operation need not be described minutely since the detailed operation thereof will be readily understood by those skilled in the art from an examination and study of the detailed circuit diagram in FIG. 5 and from the general operational description previously presented.

The subject power amplifier circuit as depicted in the preferred embodiment of FIG. 5 includes a grounded voltage divider circuit that includes the resistors 176–182 and which is connected to lead 78 to receive output signals from the torque limit circuit. Depending upon the particular brake or clutch being employed with the subject feedback control system, and the gain desired in the power amplifier circuit, jumper connectors may be employed across resistors 176 and/or 178 in order to match the system and brake characteristics and to select the power amplifier circuit gain, as will be appreciated from what follows. A lead 174 is connected into the voltage divider circuit to detect the voltage present across resistor 182, and that lead extends therefrom to the positive input terminal 184 of an Op amplifier 186 whose output 187 is fed back to its negative input terminal 194 through a resistor 201 in parallel with capacitor 203. The purpose of this feedback is to stabilize the current feedback circuit. The output 187 of Op amplifier 186 drives a PNP transistor 189 which is connected in a common emitter configuration to drive, in turn, a current source circuit 207 through the parallel resistor network 191 and a lead 193. The current source circuit 207, which will be described in more detail shortly, controls current through the clutch/brake 82, one side of which is connected to a grounded resistor 197 and the other side of which is connected to a grounded varistor 211 and also to and through a normally closed uncouple contact 199 and a normally closed set of relay contacts 230 to a lead 213. Power is provided to the current source circuit 207 from a bridge rectifier circuit 205 through the contacts of a TENSION ON/OFF switch 236, which will be discussed hereinafter, and a lead 266. In the preferred embodiment depicted in FIG. 5, current source circuit 207 includes three parallel NPN transistors 250, 252, and 254, whose bases are connected in common to lead 193, whose collectors are connected in common to lead 213, and whose emitters are connected through respective resistor pairs 260A, 261; 262, 263; and 264, 265 to lead 266. Each of resistors 260A, 262, and 264, and each of resistors 261, 263, and 265, are of respective equal values to ensure equal current sharing by the transistors 250, 252, and 254, and resistor 260A is part of a potentiometer 260 for reasons that will become apparent shortly. Current source circuit 207 is protected from excessively high collector currents by a current limiting circuit 195 which includes an NPN transistor 268 whose collector is connected to lead 193, whose emitter is connected to lead 266, and whose base is connected through a diode 201 to the movable contact of potentiometer 260, which circuit acts to limit the base drive of all three parallel transistors 250, 252, and 254.

Op amplifier 186, transistor 189, resistor network 191, and current source circuit 207 together form a high voltage, high power operational amplifier which provides current for the clutch/brake 82. Feedback for this amplifier is derived from the voltage across resistor 197 and is fed back to the negative input 194 of Op amplifier 186 through gain modification potentiometer 188, the movable contact 190 thereof, and a resistor 192. A Zener diode 183 is connected between negative input 194 of Op amplifier 186 and ground to provide protection from high voltage conditions. Since the feedback voltage is proportional to load current the circuit will act to maintain the load current proportional to the input voltage on lead 174. During normal operation the feedback voltage, and, consequently, the clutch/brake current, will be independent of the setting of the gain modification potentiometer 188, the purpose and further connection of which will be more fully explained and described hereinafter.

Lead 213, which is connected in common to the collectors of transistors 250, 252, and 254 of current source circuit 207, is also connected through a Zener diode 231 to a constant current circuit 223 which is connected across a diode drop network 225, the significance of which will be appreciated from what follows. As has previously been indicated, the Op amplifier 186, transistor 189, resistor network 191, and current source circuit 207 form a high voltage, high power operational amplifier which includes therewith feedback of the voltage across resistor 197. The resulting high power operational amplifier has a high open loop gain, and, consequently, if the actual current through the clutch/brake 82 were less than the commanded current by even a small amount, current source circuit 207 would saturate. The clutch/brake current would therefore increase at the maximum rate possible for the supply voltage, and would continue to do so until the commanded current were reached, at which time current source circuit 207 would automatically come out of saturation to hold the current constant at the commanded value. If, on the other hand, the actual current were more than the commanded current by even a small amount, current source circuit 207 would cut off, and the current which had been flowing through the clutch/brake 82 would then flow through Zener diode 231 and the diode network 225. Since Zener diode 231 would be conducting at its Zener voltage, the clutch/brake current would decrease at a rate corresponding to that at which the current would decrease if Zener diode 231 were a battery of corresponding voltage that would eventually drive the clutch/brake current in the opposite direction. The current would continue to decrease at such rate until the clutch/brake current reached the new desired current, at which time the current source circuit 207 would automatically begin to conduct to hold the current at its desired value.

Diode drop network 225 thus provides a path to ground for the clutch/brake current when current source circuit 207 is cut off, and the inclusion of the diodes, instead of a simple connector to ground, within such path also serves to prevent application of a short across the clutch/brake during forward conduction of Zener diode 231. If the only function of the diodes within the diode drop network 225 were to prevent such a short, only one diode would be required. However, the diode drop network 225 is also utilized with the constant current source 223 to provide a small reverse bias on the clutch/brake 82, which action effects removal of the residual magnetism of the clutch/brake in order to reduce the drag torque thereof. Since the current available from constant current source 223 is greater than the maximum reverse current required for any clutch/brake, diode drop network 225 is employed to limit the reverse current applied to the clutch/brake, and this is accomplished by connecting into the diode drop network, as shown, a plurality of diodes through which a portion of current from the current source circuit 223 may flow. As current flows through such diodes each of the diodes in the network contributes to total forward voltage drop of the network, and this voltage, minus the forward voltage drop of Zener diode 231, provides a resulting voltage value which acts to limit reverse current to the clutch/brake 82 since the resulting voltage value divided by the coil resistance of clutch/brake 82 determines the reverse current provided.

The normally closed uncouple contact 199 may be operated under external control to open in instances when rapid uncoupling of the clutch 82 is desired, and when the contact 199 is so opened the coil current through the clutch 82 will be rapidly driven to zero by reason of the dumping of the coil energy into the varistor 211. The desirability of providing such a rapid uncouple feature has been previously discussed, in which discussion it has been explained that the emergency stop control of a web drive system may, in appropriate applications, be utilized to provide an uncouple signal to the subject tension control system. In the embodiment depicted in FIG. 5 actuation of the emergency stop control would effect the opening of the contact 199, which corresponds generally to production of an uncouple signal at input 81 in FIG. 3, and this, in turn, would effect resultant rapid uncoupling due to the effect of varistor 211. As will be apparent, the normally closed relay contacts 230 likewise may be caused to open, as will be explained more fully hereinafter with respect to the start-up circuitry, to effect a similar result.

Gain modification potentiometer 188, which forms a portion of the feedback circuit to negative input 194 of Op amplifier 186, is also connected through a resistor 196 and a normally open gain modification contact 198 to ground. As has previously been indicated, during normal operation of the tension control system the feedback voltage across resistor 197 to negative input 194 of Op amplifier 186 is independent of the setting of gain modification potentiometer 188, and this is true because gain modification contact 198 remains open. As has previously been discussed, it is desirable in some applications of web drive systems to be able to increase the gain of the power amplifier circuit 84 of the subject tension control system in the event of a web drive system emergency stop. The normally open contact 198 may be operated under external control to close in instances when gain modification is desired, and when the contact 198 is so closed, which corresponds generally to production of a gain modification signal at input 80 in FIG. 3, the voltage fed back to the negative input terminal 194 of Op amplifier 186 will change and will depend upon the setting of the potentiometer 188. The change in voltage feedback will result in an increase in gain, and, as has previously been explained, an increase in braking current. The amount of gain increase that may be realized would be determined by the selective values of potentiometer 188 and the resistor 196, and in a particular instance, upon the setting of potentiometer 188.

The circuit embodiment of FIG. 5 also includes start-up circuitry corresponding to the start-up circuitry described with respect to FIG. 4. Included in circuitry which corresponds to monostable circuit 90 is a monostable Op amplifier circuit 200 whose negative input terminal 202 is connected through an input filter circuit including capacitors 204 and 206 and a resistor 208 to a lead 210, which lead is connected through resistors 212 and 215 to a −12 V source, and through resistor 212 and lead 88 to one side 214A of a normally open start-up switch 214 which is typically located on the control panel 38 or at some other suitable location. The other side 214B of the start-up switch 214 is grounded. The amplifier 200 has suitable biasing and other control connections and produces outputs on a lead 216 which is connected through resistor 218 and a diode 220 to the base of an PNP transistor 222 whose emitter is grounded and whose collector is connected to a voltage source, in this instance, of −18 V, through lead 92 and a relay coil 224 that controls three sets of relay contacts 226, 228, and 230. The relay contacts 226 and 228 are normally open contacts which close when the relay coil 224 is energized, and the relay contacts 230, which are in the power amplifier circuit, are normally closed contacts which open when the relay coil 224 is energized. The subject circuit has been designed and constructed such that closure of the start-up switch 214 will result in generation of an approximately 200 msec. output pulse from amplifier 200 and the consequent opening and closing of relay contacts 226, 228, and 230 in response to energization of the relay coil 224. The opening of the relay contacts 230 causes the current to the brake 82 to be rapidly driven to zero and fast turn off of the brake to be effected during web feed start up, all of which has been previously described with reference to FIG. 4. The function of the other relay contacts 226 and 228 will be explained and described more fully by what follows hereinafter. It will be appreciated, however, that the relay coil 224 and the relay contacts 226–230 correspond generally to the signal coupling means 103–106 previously discussed, and that energization of the relay coil 224 effects the opening and closing of relay contacts 226–230 and, so, effects the coupling of the signal produced on lead 92 to the circuits in which the relay contacts 226–230 are included.

Further included in the circuit embodiment of FIG. 5 is circuitry which corresponds to start time circuit portion 94 of FIG. 4 and which includes a differential Op amplifier 232 whose negative input terminal 248 is connected through a resistor 252 to the movable contact 253 of a start time potentiometer 254 which is connected in series with a resistor 256 and a diode 258 between a positive voltage source, in this instance, of +18 V, and ground. Positive input terminal 260 of amplifier 232 is connected through resistor 262 to node 257 between resistor 256 and diode 258. Adjustment of the movable contact 253 thus establishes a differential input to amplifier 232. The output terminal 250 of amplifier 232 is connected back to negative input terminal 248 through a parallel circuit configuration including relay contacts 226 in parallel circuit with the series circuit including capacitor 244 and resistor 246. Close of the relay contacts 226 when relay coil 224 is energized results in a virtual short circuit between output terminal 250 and negative input terminal 248 of amplifier 232, and the importance of this with respect to the web feed start-up circuitry will become apparent from that which follows.

As has previously been indicated, the tension reference signal is produced on lead 102, and, as described with respect to FIGS. 2 and 4, the deviation of the actual tension signal from the tension reference signal effects action by the feedback tension control system to correct the tension deviation from norm or reference. In the circuit embodiment of FIG. 5 the tension reference signal produced on lead 102 is the output of circuitry that corresponds to limit level circuit 98, and the value of the tension reference signal is dependent upon the values of the signals present on leads 96 and 238. Lead 102 is connected to lead 96 through diode 242, and, through lead 96, is connected to the feedback circuit associated with differential amplifier 232 at a point between capacitor 244 and resistor 246. Lead 102 is also connected through resistor 240 to lead 238 and therethrough to the movable contact 234A of TENSION switch 234 which is mechanically ganged to TENSION ON/OFF switch 236. When TENSION ON/OFF switch 236 is in its open or OFF position, movable contact 234A of TENSION switch 234 is positioned in communication with fixed contact 234B and through leads 235 and 237 to ground. When start up switch 214 is in its normal open (non-start-up) position, and the feedback tension control system is in its normal (non-start-up) mode of operation, if the TENSION ON/OFF switch 236 is maintained in an OFF state, a virtual ground is applied to lead 238, and, since a negative signal is present on lead 96, this results in the reverse biasing of diode 242 and the application of a virtual ground to lead 102. If the TENSION ON/OFF switch 236 is then activated to achieve a tension ON condition, movable contact 234A of switch 234 would be caused to move into communication with fixed contact 234C, thus resulting in operative connection of lead 238 to movable contact 239 of potentiometer 100, which potentiometer is connected between ground and a negative voltage source, in this instance, of −12 V. Consequently, depending upon the adjustment of potentiometer 100, a signal of between 0 and −12 V may be applied to lead 238, and, since in normal (non-start-up) operation the signal on lead 96 will be more negative than the signal applied to lead 238, diode 242 will be reverse biased and the tension reference signal that results will depend upon the setting of potentiometer 100.

If start-up switch 214 is closed, however, such as at the initiation of a web feed system start-up, start monostable circuit 90 will effect generation of a 200 msec. output the effect of which is to energize relay coil 224 and cause relay contacts 226 to close, as has been previously described. When relay contacts 226 close a virtual short circuit is introduced between the output terminal 250 and the negative input terminal 248 of amplifier 232, and, as a consequence, the signal on lead 96 will become less negative and approach the potential set by the diode 258, thereby forward biasing diode 242 and resulting in application of a virtual ground to lead 102 while the relay contacts 226 remain closed. When the relay contacts 226 thereafter open because of deenergization of relay coil 224 due to conclusion of the 200 msec. output from start monostable circuit 90, the short between output terminal 250 and input terminal 248 will be removed, and the signal on lead 96 will begin to go more negative and will continue to do so until it reaches its steady state value. During such time, until the diode 242 becomes reverse biased, the value of the signal applied to lead 102 will be limited by the value of the signal on lead 96. Adjustment of start time potentiometer 254 establishes the time constant of the start time circuit 94, and, so, establishes the time during which the tension reference signal will be limited and gradually brought into play following web feed start-up. Typically, this time may be varied between a fraction of a second to a minute or longer.

Consequently, as has previously been explained, the start-up circuitry, because of the opening of relay contacts 230, drives the braking force of brake 82 to zero for approximately 200 msec. after web feed system start-up, and, because of the closing of relay contacts 226, also drives the tension reference signal to zero for approximately 200 msec. following start-up, after which the tension reference signal is limited for a length of time as determined by adjustment of start time potentiometer 254. It will be remembered from the description and explanation of the start-up circuitry of FIG. 4 that such circuitry also includes means for driving the output of the integrator portion 68 of proportional-plus-integral feedback network 69 to zero during the 200 msec. period following web feed system start-up. In the circuit embodiment of FIG. 5 this is accomplished by means of relay contacts 228 which are connected in parallel with capacitor 158 and resistor 160 in the feedback circuit associated with Op amplifier 144, which contacts close when relay coil 224 is energized in response to production of the 200 msec. output pulse from start monostable circuit 90 upon web feed system start-up. From the foregoing it will be clearly understood that when the web feed system has been shut down or stopped for some reason, and is to be restarted, either initially at the beginning of the day or after trouble has developed which required the stopping of the web feed system, the start-up circuitry of the feedback tension control system will respond to web feed system start-up by eliminating all braking force from the web for an initial short time period, and by thereafter gradually bringing into play the full capabilities of the feedback control system and establishing and controlling the web tension. The advantages of such circuitry and operation are many and varied, as has been previously pointed out.

Although FIG. 5 depicts a preferred circuit embodiment of the subject tension control system, it will be apparent that other embodiments could equally as well be employed, and that other types and designs of the various means utilized therewith could be utilized, depending upon circuit design. For example, while the signal coupling means 103–106 depicted in FIGS. 2–4 are described with respect to FIG. 5 in terms of a relay coil 224 and relay contacts 226–230, such signal coupling means may, in some embodiments, include optical or other couplers, or even simple lead connections, depending upon the design of the particular circuit portions being coupled. Additionally, it will be appreciated that the power amplifier circuit 84 described herein, a preferred embodiment of which is depeicted in FIG. 5, may have used in other applications than with tension control systems. For example, the power amplifier circuit might also, in some instances, be advantageously employed as part of a motor drive or other circuit apart from other components of the subject tension control system. Similarly the setup control 61 may be advantageously employed in other, more conventional control systems, including other tension control systems, although it will be most advantageously employed in conjunction with the power amplifier circuit 84. Furthermore, although the control system described herein has been described with respect to tension monitoring and control, it should be recognized that such system could be employed in other applications also. For example, instead of being connected to receive input signals from a tension transducer, as depicted in FIG. 2, the control system could be connected to receive input signals from a speed detector/transducer, and the control system would then function as has been described to control the speed at the point of the speed detector/transducer.

Consequently, it will be appreciated that the subject control system, among other things, provides the opportunity and means to accurately adjust and control the tension on a moving web or strand over a wide range of values; it provides the benefit of a stable control system which has optimal response characteristics for both small and large tension deviations from norm; and it provides means to prevent damage to a web or strand during start-up operations of the web feed system with which the subject feedback tension control system would be employed. The present construction also provides means to limit the amount of torque that can be applied in a particular system and it provides means to apply reverse voltage to the clutch or brake 82 at certain times to make such that all braking force, including even residual braking force, is removed.

Thus, there has been shown and described novel monitor and control means and a novel system thereof which fulfills all of the objects and advantages sought therefor. It will be apparent to those skilled in the art, however, that many changes, modifications, variations, and other uses and applications of the subject monitor and control means and system are possible and contemplated. All such changes, modifications, variations, and other uses and applications which do not depart from the spirit and scope of the invention are deemed to be covered by the invention which is limited only by the claims which follow:

What is claimed is:

1. A tension control device for a web handling system including a roller over which a web of material passes, comprising means associated with the roller including transducer means for detecting the tension of the web passing over the roller and for producing tension monitor responses that very therewith, means operatively connected to the web to move the web over the roller, controllable force applying means for applying tensional forces to the web, said controllable force applying means including inductive means, and controller means to control the tension on the web, said controller means including means for establishing a desired web tension and for producing a signal representative thereof, comparison means responsive to said tension monitor responses and to the signal representative of the desired web tension for controlling the amount of tensional force applied to the web, said comparison means including means for receiving said tension monitor responses and the signal representative of the desired web tension and for producing responses representing the differences between the tension detected and the desired web tension, error limiter means responsive to said difference responses to produce error limiter responses, said error limiter means having an input connected to receive said difference responses and an output at which said error limiter responses are produced, said error limiter means passing positive difference responses less than or equal to a predetermined positive value and limiting the magnitude of the difference responses greater than the predetermined positive value, means operatively connected to said output of said error limiter means to integrate said error limiter responses and to produce integrated error limiter outputs, and signal conditioning means connected to operatively apply such integrated error limiter outputs to the force applying means to control the amount of tensional force applied to the web by the force applying means, said signal conditioning means including amplifier means having a control input operatively connected to receive said integrated error limiter outputs and an output operatively connected to said inductive means, energy dissipation means, and means connecting said energy dissipation means to the inductive means to permit excess energy associated with the inductive means to be rapidly dissipated when power from such amplifier means to said inductive means is interrupted.

2. The tension control device of claim 1 wherein said amplifier means includes means for producing and providing a reverse bias to the inductive means to effect removal of residual magnetism therefrom when power from said amplifier means to the inductive means is interrupted.

3. The tension control device of claim 1 wherein said signal conditioning means includes operator actuatable means therewith operable to interrupt power from said amplifier means to the inductive means.

4. The tension control device of claim 1 wherein said amplifier means includes means associated therewith and responsive to said integrated error limiter outputs for controlling the supplying and interruption of power from said amplifier means to the inductive means.

5. The tension control device of claim 1 wherein said error limiter means passes negative difference responses greater than or equal to a predetermined negative value and limits the magnitude of the difference responses less than the predetermined negative value.

6. The tension control device of claim 5 wherein the absolute values of said predetermined positive value and said predetermined negative value are equal.

7. The tension control device of claim 1 or 5 or 6 including transducer means associated with both opposite ends of the roller, and means for combining the responses produced by the transducer means for producing the responses that vary with the web tension.

8. The tension control device of claim 1 or 5 or 6 wherein the transducer responses, the signal representative of the desired web tension, and the difference responses are electric signals.

9. The tension control device of claim 1 wherein the web handling means includes web start up means operatively connected to the means to move the web over the roller, the web start up means producing a web drive signal, the tension control device including means to establish a tension control start up time interval of predetermined duration, and means separate from the web start up means and responsive to the web drive signal to inhibit the application of integrated error limiter responses to the force applying means during said tension control start up time interval.

10. The tension control device of claim 9 wherein said time interval commences when the means to move the web over the roll is energized.

11. The tension control device of claim 1 or 5 or 6 wherein said means to apply the integrated error limiter responses to the force applying means includes amplifier means.

12. In a web handling system having tension control means for controlling tension on a web of material, the web handling system including at least one roller around which the web extends and drive means operable to move the web around the roller, the tension control means including tension monitor means associated with the roller for producing tension monitor responses representative of the tension on the web as it moves around the roller, a controllable magnetic particle device operable to effect changes in the web tension, and feedback control means responsive to the tension monitor responses for controlling the operation of the magnetic particle device, the improvement in the feedback control means of the web handling system comprising means for establishing a response representative of a desired web tension to be maintained, comparison means including means for receiving the response representative of the desired web tension and the tension monitor responses, said comparison means being responsive to the response representative of the desired web tension and to the tension monitor responses for producing an error response representative of the difference between the response representative of the desired tension and the response produced by the tension monitor means associated with the roller, error limiter means having an input connected to receive said error responses and an output connection, said error limiter means being responsive to said error responses to produce error limiter outputs at said error limiter output connection, said error limiter means including means responsive to a first set of error indications for producing non-constant error limiter outputs functionally related to said error indications and responsive to a second set of error indications for producing error limiter outputs of limited value, means operatively connected to said error limiter output connection to integrate said error limiter outputs produced thereat, and signal conditioning means including amplifier means for operatively applying the integrated error limiter outputs to the magnetic particle device to control the operation thereof, said signal conditioning means including energy dissipation means connected to the magnetic particle device to permit excess energy associated with the magnetic particle device to be dissipated when power from said amplifier means to the magnetic particle device is interrupted.

13. The feedback control means of claim 12 wherein said amplifier means includes means for producing and providing a reverse bias to the magnetic particle device to effect removal of residual magnetism therefrom when power from said amplifier means to the magnetic particle device is interrupted.

14. The feedback control means of claim 12 wherein said signal conditioning means includes operator actuatable means therewith operable to interrupt power from said amplifier means to the magnetic particle device.

15. The feedback control means of claim 12 wherein said amplifier means includes means associated therewith and responsive to said integrated error limiter outputs for controlling the supplying and interruption of power from said amplifier means to the magnetic particle device.

16. The feedback control means of claim 12 wherein said first set of error indications includes positive error indications whose values are less than or equal to a predetermined value, said second set of error indications includes positive error indications whose values are greater than the predetermined value, and said responsive means of said error limiter means is responsive to the positive error indications of value greater than the predetermined value for producing outputs limited to a maximum value.

17. The feedback control means of claim 12 wherein said first set of error indications includes negative error indications whose values are greater than or equal to a predetermined value, said second set of error indications includes negative error indications whose values are less than the predetermined value, and said responsive means of said error limiter means is responsive to the negative error indications of value less than the predetermined value for producing outputs limited to a minimum value.

18. The feedback control means of claim 12 wherein said first set of error indications includes error indications within a range of values between a predetermined positive value and a predetermined negative value, said second set of error indications includes error indications outside of such range, and said responsive means of said error limiter means is responsive to error indications of value greater than the predetermined positive value for producing outputs limited to a maximum value and responsive to error indications of value less than the predetermined negative value for producing outputs limited to a minimum value.

19. The feedback control means of claim 12 including proportional feedback means operatively connected to said error limiter output connection and responsive to said error limiter outputs for producing proportional feedback outputs, said means for applying the integrated error limiter outputs to the magnetic particle device also applying the proportional feedback outputs thereto.

20. A control for controlling tension on a movable web comprising a system for supporting a web for movement, said system including at least one web handling roll, web drive means for effecting web movement, and means to apply force to the web during movement, said control including means associated with a web handling roll for detecting web tension thereat and for producing a tension monitor response representative of such tension, means to establish a reference response representative of a desired web tension, means for receiving said tension monitor response and said reference response and for producing difference responses representative of the differences between the tension monitor responses produced by the means associated with the system roll and the reference response representative of the desired web tension, error limiter means responsive to said difference responses to produce error limiter signals the magnitudes of which are limited in magnitude for a predetermined set of difference responses, said error limiter means including a input connected to receive said difference responses and an output at which said error limiter signals are produced, means operatively connected to said error limiter output to integrate the error limiter signals produced thereat, tension correction means responsive to the integrated error limiter signals for varying the tension on the web to reduce the difference between the web tension detected and the desired tension, said tension correction means including coupling means operatively coupling the web drive means to a web handling roll, coupling control means for controlling the operation of said coupling means, and means operatively connecting said integrating means to said coupling control means, said coupling control means being responsive to the integrated error limiter signals to control said coupling means, said coupling means including inductive means, said coupling control means including amplifier means and energy dissipation means, said amplifier means operatively connected to supply power to said inductive means under control of the integrated error limiter signals, said energy dissipation means connected to said inductive means to permit excess energy to be rapidly dissipated from the inductive means when power from the amplifier means to the inductive means is interrupted.

21. The control of claim 20 wherein said amplifier means includes means for producing and providing a reverse bias to the inductive means to effect removal of residual magnetism therefrom when power from said amplifier means to the inductive means is interrupted.

22. The control of claim 20 wherein said coupling control means includes operator actuatable means therewith operable to interrupt power from said amplifier means to the inductive means.

23. The control of claim 20 wherein said amplifier means includes means associated therewith and responsive to said integrated error limiter signals for controlling the supplying and interruption of power from said amplifier means to the inductive means.

24. The control of claim 20 wherein said predetermined set of difference reponses includes difference responses greater than a predetermined positive value.

25. The control of claim 20 or 24 wherein said predetermined set of difference responses includes difference responses less than a predetermined negative value.

26. The control of claim 20 including means responsive to said error limiter signals to produce proportional feedback responses, said means operatively connecting said integrating means to said coupling control means also connecting said coupling control means to respond to said proportional feedback responses.

27. In a closed-loop system for maintaining substantially constant tension on a web of material, the system including a web, a roller over which the web moves, drive means to move the web over the roller including drive start means producing a drive start signal, means to apply force to the web to maintain the tension on the web substantially constant including a device having a control element to which control responses are applied to vary the web tension, transducer means associated with the roller including means for producing a response representative of the web tension, and control means responsive to the responses produced by the transducer to produce control responses, the improvement comprising tension control start up means separate from the drive means, said tension control start up means including means to establish an initial tension control start up time interval of predetermined duration, said tension control start up means responsive to the drive start signal to inhibit the application of control responses to the control element of the means for applying force to the web during said tension control start up time interval and to thereby prevent said force applying means from applying force to the web during said tension control start up time interval.

28. In the system of claim 27 the improvement further including means to limit the magnitude of the responses applied to the control element for a predetermined time subsequent to said start up time interval.

29. Tension control means for use in a web handling control system to control the tension of a web being handled in an ongoing process wherein the web handling control system includes means for monitoring the tension of the web at a preselected point and for producing tension monitor responses representative of the time varying values of the tension at such point, the web handling control system also including controllable means capable of effecting changes in the value of the tension, such controllable change effecting means including inductive means, said tension control means including means for establishing a predetermined web tension value and for producing a signal representative thereof, comparison means adapted to receive the tension monitor responses and the signal representative of the predetermined web tension value, said comparison means including an output and being responsive to the tension monitor responses and the signal representative of the predetermined web tension value to produce at said output error indications representative of the variances of the varying value from the predetermined web tension value, error limiter means connected to said output of said comparison means to receive said error indications and to produce error limiter outputs in response thereto, said error limiter means including means responsive to a first set of error indications for producing varying outputs functionally related to said error indications and responsive to a second set of error indications for producing outputs of limited value, error correction means connected to receive said error limiter outputs and responsive thereto to produce error correction indications, said error correction means including integration means for integrating said error limiter outputs, and signal conditioning means connected to receive said error correction indications and responsive thereto for operatively communicating and providing control signals to the controllable change effecting means of the web handling control system for effecting changes in the tension being monitored in accordance with said error correction indications to reduce the variance of the tension value detected at a given time from the predetermined web tension value, said signal conditioning means including amplifier means having an output operatively connected to the controllable change effecting means of the web handling control system to control the controllable means, said amplifier means being a linear current amplifier including a current source for supplying power, means connecting said current source to the inductive means, means associated with said current source for controlling the supply and cutting off of current from said current source, said associated means including a control input operatively connected to receive said error correction indications, high voltage dissipation means, and means connecting said high voltage dissipation means to the inductive means to permit excess energy of the inductive means to be rapidly dissipated when the supply of current from said current source is cut off.

30. The tension control means of claim 29 wherein said first set of error indications includes positive error indications whose values are less than or equal to a predetermined value, said second set of error indications includes positive error indications whose values are greater than the predetermined value, and said responsive means of said error limiter means is responsive to the positive error indications of value greater than the predetermined value for producing outputs limited to a maximum value.

31. The tension control means of claim 29 wherein said first set of error indications includes negative error indications whose values are greater than or equal to a predetermined value, said second set of error indications includes negative error indications whose values are less than the predetermined value, and said responsive means of said error limiter means is responsive to the negative error indications of value less than the predetermined value for producing outputs limited to a minimum value.

32. The tension control means of claim 29 wherein said first set of error indications includes error indications within a range of values between a predetermined positive value and a predetermined negative value, said second set of error indications includes error indications outside of such range, and said responsive means of said error limiter means is responsive to error indications of value greater than the predetermined positive value for producing outputs limited to a maximum value and responsive to error indications of value less than the predetermined negative value for producing outputs limited to a minimum value.

33. The tension control means of any of claims 30, 31, or 32 wherein said error limiter means includes means for establishing a predetermined error limit value.

34. The tension control means of claim 29 wherein said means for establishing a desired web tension value includes operator adjustable means operable to effect a change in the desired web tension value.

35. The tension control means of claim 29 wherein said error correction means includes proportional feedback means responsive to said error limiter outputs for producing proportional feedback outputs and means for combining said proportional feedback outputs and the integrated error limiter outputs to produce said error correction indications.

36. The tension control means of claim 35 wherein said proportional feedback outputs are related to said error limiter outputs by a proportionality factor and said proportional feedback means includes operator adjustable means for adjusting and varying said proportionality factor.

37. The tension control means of claim 29 wherein said signal conditioning means includes means operatively connected between said error correction means and said amplifier means to limit the value of the error correction indications communicated to said amplifier means to a predetermined maximum value.

38. The tension control means of claim 29 wherein said associated means includes means for detecting the amount of current being supplied to the inductive means and for producing current detection responses representative of the amounts of current detected, input amplifier means having a first input operatively connected to receive said error correction indications, a second input operatively connected to receive said current detection responses, and an output operatively connected to said current source to control supply and cutting off of current by said current source.

39. The tension control means of claim 29 wherein said linear current amplifier includes means for producing and providing a reverse bias to the inductive means to effect removal of residual magnetism therein when the supply of current from said current source is cut off.

40. The tension control means of claim 29 wherein the web handling control system includes web drive means to effect web movement, and web start means actuatable to produce a start indication, the web drive means responsive to actuation of the web start means to effect web movement, and wherein said means of the tension control means for establishing a predetermined web tension value includes setup control means operatively connected to receive the start indication produced by the web start means, said setup control means being responsive to the start indication to prevent said signal conditioning means from operatively communicating and providing control signals to the controllable change effecting means of the web handling control system for a predetermined time interval following actuation of the actuatable web start means and to inhibit said integration means during said predetermined time interval to prevent the integration of error limiter outputs.

41. The tension control means of claim 40 wherein said setup control means includes reference alteration means responsive to the start indication to effect changes in said predetermined web tension value during a preset time interval following actuation of the actuatable web start means.

42. The tension control means of claim 41 wherein said preset time interval is longer in duration than said predetermined time interval, said means for establishing a predetermined web tension value includes means for establishing a reference value, and said predetermined web tension value is driven to and maintained at a preestablished constant value during said predetermined time interval regardless of the reference value established and is thereafter limited during the remainder of said preset time interval as a time function of the reference value established.

43. The tension control means of claim 42 wherein said reference alteration means includes operator adjustable means for adjusting the time duration of the remainder of said preset time interval.

44. The tension control means of claim 42 wherein said predetermined web tension value is limited during the remainder of said preset time interval as an essentially linear time function of the reference value established.

45. The tension control means of claim 29 wherein said signal conditioning means includes operator actuatable means therewith and said amplifier means includes uncouple means therewith responsive to actuation of said operator actuatable means to prevent operative communication and providing of control signals to the controllable change effecting means of the web handling control system.

46. The tension control means of claim 29 wherein said signal conditioning means includes operator actuatable means therewith and said amplifier means includes gain modification means therewith responsive to actuation of said operator actuatable means to effect a change in the gain of said amplifier means.

47. The tension control means of claim 29 wherein the web handling control system includes web drive means to effect web movement and web start means actuatable to produce a start indication, the web drive means responsive to actuation of the web start means to effect web movement, and wherein said means of the tension control means for establishing a predetermined web tension value includes means for establishing a reference value, tension control start time means having an output connection and producing an output signal at said output connection, said output signal normally being of a substantially constant first value, limit level means having a first input connected to said means for establishing a reference value and a second input operatively connected to said tension control start time means output connection, said limit level means producing said predetermined tension value, said predetermined tension value being a function of the reference value established by the means for establishing a reference value and of the tension control start time means output signal, tension control start trigger means responsive to the start indication produced by the web start means to produce a tension control timed start indication of a predetermined duration, said tension control start time means being responsive to said tension control timed start indication for altering the value of said tension control start time output signal, said start time output signal being altered to be essentially constant at a second value for the duration of said tension control timed start indication, to be a non-constant function of time during a succeeding preset time interval, and to return to said substantially constant first value thereafter, actuation of the web start means thereby effecting changes in the predetermined tension value for the duration of the timed start indication and of the succeeding preset time interval, means responsive to said tension control timed start indication to prevent said signal conditioning means from operatively communicating and providing control signals to the controllable change effecting means of the web handling control system for the duration of said timed start indication, and means responsive to said timed start indication to inhibit said integration means for the duration of said timed start indication.

48. The tension control means of claim 47 wherein said constant first value is zero and the predetermined tension value is essentially zero for the duration of said timed start indication and is the lesser of the etablished reference value and the start time output at any other given time.

49. The tension control means of claim 29 wherein said integration means includes operator adjustable means for adjusting and varying the integrator time constant.

50. Setup control means for use in a tension control system for controlling the tension of a web being handled under control of a web handling control system in an ongoing process under control of a process control system wherein the web handling control system includes web drive means for effecting web movement, web start means actuatable to produce a start indication, the web drive means responsive to actuation of the web start means to effect web movement, means for monitoring the tension of the web being handled and for producing responses representative of the varying values of the tension, and controllable means for effecting changes in the force being applied to the web and in the tension being monitored, and wherein the tension control system includes means for establishing a predetermined tension value, and tension controlling means including integration means responsive to the responses representative of the varying values of the tension to produce error correction indications and connection means to operatively communicate and provide the error correction indications to the controllable means to control the controllable means and effect changes in the tension being monitored to reduce the variance of the tension value detected from the predetermined tension value, said setup control means being independent of the web drive means and operatively connected to receive the start indication from the web start means, said setup control means including means responsive to the start indication produced by the web start means to prevent the tension controlling means from operatively communicating and providing said error correction indications to the controllable means of the web handling control system for a predetermined time interval following actuation of the actuatable web start means and to inhibit the integration means during the predetermined time interval, said setup control means thereby preventing the controllable means from effecting changes in the force being applied to the web during the predetermined time interval.

51. Setup control means for use in a tension control system for controlling the tension of a web being handled under control of a web handling control system in an ongoing process under control of a process control system wherein the web handling control system includes web drive means for effecting web movement, web start means actuatable to produce a start indication, the web drive means responsive to actuation of the web start means to effect web movement, means for monitoring the tension of the web being handled and for producing responses representative of the varying values of the tension, and controllable means for effecting changes in the tension being monitored, and wherein the tension control system includes means for establishing a predetermined tension value, and tension controlling means including integration means responsive to the responses representative of the varying values of the tension to produce error correction indications and connection means to operatively communicate and provide the error correction indications to the controllable means to control the controllable means and effect changes in the tension being monitored to reduce the variance of the tension value detected from the predetermined tension value, said setup control means being independent of the web drive means and operatively connected to receive the start indication from the web start means, said setup control means including means responsive to the start indication produced by the web start means to prevent the tension controlling means from operatively communicating and providing said error correction indications to the controllable means of the web handling control system for a predetermined time interval following actuation of the actuatable web start means and to inhibit the integration means during the predetermined time interval, said setup control means including reference alteration means responsive to said start indication to effect changes in the predetermined tension value during a preset time interval following actuation of the actuatable start means.

52. The setup control means of claim 51 wherein said preset time interval is longer in duration than the predetermined time interval, said means for establishing a predetermined tension value includes means for establishing a reference value, and the predetermined tension value is driven to and maintained at a preestablished constant value during said predetermined time interval regardless of the reference value established and is thereafter limited during the remainder of said preset time interval as a time function of the reference value established.

53. The setup control means of claim 52 wherein said reference alteration means includes operator adjustable means for adjusting the time duration of the remainder of said preset time interval.

54. The setup control means of claim 52 wherein the predetermined characteristic value is limited during the remainder of said preset time interval as an essentially linear function of the reference value established.

55. Setup control means for use in a tension control system for controlling the tension of a web being handled under control of a web handling system in an ongoing process under control of a process control system wherein the web handling control system includes web drive means for effecting web movement, web start means actuatable to produce a start indication, the web drive means responsive to actuation of the web start means to effect web movement, means for monitoring the tension of the web being handled and for producing responses representative of the varying values of the tension, and controllable means capable of effecting changes in the value of the tension, and wherein the tension control system includes integration means responsive to the responses representative of the varying values of the tension to produce error correction indications representative of variances of the detected tension values from a predetermined tension value and connection means to operatively communicate and provide the error correction indications to the controllable means to control the controllable means and effect changes in the tension being monitored to reduce the variances of the tension value detected from the predetermined tension value, said setup control means being independent of the web drive means and including means for establishing a reference value, tension control start time means having an output connection and producing an output signal at said output connection, said output signal normally being of a substantially constant first value, limit level means having a first input connected to said means for establishing a reference value and a second input operatively connected to said tension control start time means output connection, said limit level means producing the predetermined tension value, said predetermined tension value being a function of the reference value established by the means for establishing a reference value and of the tension control start time means output signal, tension control start trigger means operatively connected to receive and be responsive to the start signal from the web start means to produce a tension control timed start indication of a predetermined duration, said tension control start time means being responsive to said tension control timed start indication for altering the value of said tension control start time output signal, said start time output signal being altered to be essentially constant at a second value for the duration of said timed start indication, to be a non-constant function of time during a succeeding preset time interval, and to return to said substantially constant first value thereafter, actuation of the web start means thereby effecting changes in the predetermined tension value for the duration of the timed start indication and of the succeeding preset time interval, means responsive to said tension control timed start indication to prevent the tension control system from operatively communicating and providing the error correction indications to the controllable means of the web handling control system for the duration of said timed start indication, and means responsive to said timed start indication to inhibit the integration means of the tension control system for the duration of said timed start indication.

56. The setup control means of claim 55 wherein said constant first value is zero and the predetermined tension value is essentially zero for the duration of said timed start indication and is the lesser of the established reference value and the start time output at any other given time.

* * * * *

UNITED STATES PATENT OFFICE
CERTIFICATE OF CORRECTION

Patent No. 4,347,993 Dated September 7, 1982

Inventor(s) Michael R. Leonard

It is certified that error appears in the above-identified patent and that said Letters Patent are hereby corrected as shown below:

Column 8, Line 41, "led 75" should be --lead 74--.

Column 9, Line 65, "had" should be --has--.

Column 22, Line 64, "Close" should be --Closure--.

Column 24, Line 60, "used" should be --uses--.

Column 25, Line 27, "such" should be --sure--.

Column 25, Line 47, "very" should be --vary--.

Column 33, Line 34, "etablished" should be --established--.

Signed and Sealed this

*Twenty-sixth* Day of *October 1982*

[SEAL]

*Attest:*

GERALD J. MOSSINGHOFF

*Attesting Officer* *Commissioner of Patents and Trademarks*